US006034482A

United States Patent [19]

Kanazawa et al.

[11] Patent Number: 6,034,482

[45] **Date of Patent: *Mar. 7, 2000**

[54] METHOD AND APPARATUS FOR DRIVING PLASMA DISPLAY PANEL

[75] Inventors: Yoshikazu Kanazawa; Keishin Nagaoka, both of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/851,703

[22] Filed: May 6, 1997

[30] Foreign Application Priority Data

Nov. 12, 1996 [JP] Japan ..... 8-300701

[51] Int. Cl.[7] ..... G09G 3/10

[52] U.S. Cl. ..... 315/169.4; 315/169.1; 315/169.3; 345/37; 345/211; 345/67

[58] Field of Search ..... 345/37, 55, 60, 345/67, 211; 315/169.1, 169.4, 169.3

[56] References Cited

U.S. PATENT DOCUMENTS

| | | | |
|---|---|---|---|
| 5,420,602 | 5/1995 | Kanazawa | 345/67 |
| 5,446,344 | 8/1995 | Kanazawa | 315/169.3 |
| 5,583,527 | 12/1996 | Fujisaki et al. | 345/55 |
| 5,744,909 | 4/1998 | Amano | 313/585 |

FOREIGN PATENT DOCUMENTS

| | | |
|---|---|---|
| 0 615 221 | 9/1994 | European Pat. Off. . |
| 0 657 861 | 6/1995 | European Pat. Off. . |
| 4-195188 | 7/1992 | Japan . |
| 5-35206 | 2/1993 | Japan . |
| 5-313598 | 11/1993 | Japan . |
| 7-160218 | 6/1995 | Japan . |

OTHER PUBLICATIONS

Beidl, et al., "Write and Erase Pulses with Opposite Polarities," *IBM Technical Disclosure Bulletin*, vol. 23, No. 12, May 1981, pp. 5442–5443.

Sano et al., "Method for Driving AC Type PDP of 40 Type Full Color Display," *Display*, Apr. 1997, pp. 46–51, with English language translation of relevant portions (6 pages).

*Primary Examiner*—Don Wong
*Assistant Examiner*—Wilson Lee
*Attorney, Agent, or Firm*—Staas & Halsey LLP

[57] ABSTRACT

A plasma display panel has pairs of parallel first and second electrodes on a first substrate defining respective display lines and third electrodes on a second substrate, facing the first substrate, disposed orthogonally to and electrically separated from the first and second electrodes and defining discharge cells at intersections therewith. A controller defines reset, addressing and sustain discharge periods in a continuing succession. Drive circuits selectively apply voltages to the electrodes so as to produce in the discharge cells, in each rest period, reset discharges achieving self-erase discharge and charge distribution equalization, in each addressing period, discharges between the second and third electrodes in selected discharge cells in accordance with writing display data therein and, in each sustain discharge period, sustain discharge pulses between the first and second electrodes in the selected discharge cells thereby to emit light in accordance with the display data. The polarity of the potential difference between the first and second electrodes in each discharge period is opposite to that in each addressing period.

44 Claims, 19 Drawing Sheets

METHOD AND APPARATUS FOR DRIVING PLASMA DISPLAY PANEL

BACKGROUND OF THE INVENTION

1. Field of the Invention

The present invention relates to a technique of driving a display panel made of a set of discharge cells each having a memory function and serving as a display element. In particular, the present invention relates to a method of, and an apparatus for, driving an alternating current (AC) type plasma display panel (PDP).

The AC-type PDP applies voltage pulses alternately to a pair of sustaining electrodes to continuously cause discharge in each discharge cell and make the cell emit light. Each discharge lasts one to several microseconds after the application of the voltage pulse. The discharge produces positive charges, i.e., ions, which accumulate on an insulating layer above the sustaining electrode that is receiving a negative voltage. The discharge also produces negative charges, i.e., electrons, which accumulate on the insulating layer above the sustaining electrode that is receiving a positive voltage. These accumulated positive and negative charges are called "wall charges."

When any discharge cell receives a high-voltage pulse (write pulse), the cell discharges and accumulates wall charges. Then, by only applying low-voltage pulses (sustaining pulses) to the cell, the wall charges increase to exceed the discharge threshold of the cell, and the cell starts to discharge. Namely, once write discharge takes place in a given cell to accumulate wall charges therein, the cell continues to discharge only by alternately applying sustain discharge pulses of opposite polarities thereto. This is the memory function or a memory effect. Generally, the AC-type PDPs use the memory effect to display data. Early versions of the AC-type PDPs mostly employed two electrodes to carry out write discharge (addressing discharge) and sustain discharge.

Color PDPs discharge to produce ultraviolet rays, which excite phosphor contained in each discharge cell. The phosphor is vulnerable to positive charges, i.e., ions produced by discharge. The two-electrode PDPs are structured such that hit the ions directly impact the phosphor, shortening the life of the phosphor.

To solve this problem, a 3-electrode surface-discharge structure has been developed. This structure has separate addressing discharge electrodes and sustain discharge electrodes. Phosphor is formed on a counter substrate that is not used for sustain discharge. Among the 3-electrode PDPs, some form first and second sustain discharge electrodes on a substrate and third electrodes on a counter substrate. Others form first to third electrodes on one substrate with the third electrodes being above or below the first and second sustain discharge electrodes.

The present invention is particularly effective when applied to 3-electrode surface-discharge AC-type PDPs.

2. Description of the Related Art

A For an easy understanding of the problems of prior art systems for driving a plasma display panel, the structure and operation of the prior art will be explained with reference to FIGS. 1 through 9.

FIG. 1 is a block diagram schematically showing peripheral circuits for driving a 3-electrode surface-discharge AC-type PDP according to the prior art. Each of addressing electrodes Aj (j=1 to M) is connected to an addressing driver 5 and is individually driven thereby. Each of scanning electrodes Yi (i=1 to N) is connected to a Y scanning driver 3 and is individually driven thereby. The Y scanning driver 3 is connected to a Y common driver 4. To write data in response to an input signal, addressing discharge is needed. Accordingly, the Y scanning driver 3 applies a scan pulse (−Vy) successively to the scanning electrodes Yi. To display the written data, sustain discharge is needed. Accordingly, the Y common driver 4 applies a sustain discharge pulse (Vs) commonly to the scanning electrodes Yi through the Y scanning driver 3. One end of each sustaining electrode Xi (i=1 to N) is connected to a common node, and the common node is connected to an X common driver 2. The X common driver 2 applies a total write discharge pulse (Vs+Vw) or a sustain discharge pulse (Vs) to the sustaining electrodes Xi.

A control circuit 6 controls these drivers and basically consists of a display data controller 7 and a panel controller 8. The display data controller 7 has a frame memory 71 for temporarily storing a frame of display data externally supplied. The display data controller 7 controls the addressing driver 5. The panel controller 8 has a scanning driver controller 81 and a common driver controller 82. The controllers 81 and 82 operate in response to a vertical synchronous signal VSYNC and a horizontal synchronous signal HSYNC that are externally supplied. The scanning driver controller 81 controls the Y scanning driver 3. The common driver controller 82 controls the Y common driver 4 and X common driver 2.

FIG. 2 is a plan view schematically showing the PDP of FIG. 1. Each pair of the scanning electrodes Yi and sustaining electrodes Xi forms a display line. The addressing electrodes Aj are orthogonal to the scanning and sustaining electrodes Yi and Xi, to form discharge cells 101 at the intersections of the electrodes. The discharge cells in the PDP are spatially separated from one another with barriers or ribs 19. The barriers 19 may completely surround and seal each discharge cell 101. In FIG. 2, the barriers 19 are formed only in one direction, and there run gaps in the other direction, to separate the discharge cells 101 from one another.

FIG. 3 is a sectional view taken along one of the addressing electrodes Aj of the PDP of FIG. 2. FIG. 4 is a sectional view taken across the addressing electrodes Aj.

Two glass substrates 11 and 14 that face each other define discharge spaces 10. The front substrate 14 supports the scanning and sustaining electrodes that run in parallel with each other. Each of the scanning and sustaining electrodes consists of a transparent electrode 15 and a bus electrode 16. The transparent electrode 15 is made of, for example, ITO (indium tin oxide) that transmits reflected light from phosphor 13. The bus electrode 16 is laminated on the transparent electrode 15, to prevent a voltage drop due to the transparent electrode 15 that has a relatively large resistance compared with metal wiring. The bus electrode 16 is opaque, and therefore, must be thin so that it will not reduce the display area. The electrodes are covered with a dielectric layer 17, which is covered with an MgO (magnesium oxide) film 18 serving as a protective film.

The front glass substrate 14 faces the back glass substrate 11, which supports the addressing electrodes Aj that are orthogonal to the scanning and sustaining electrodes Yi and Xi. Similar to the scanning and sustaining electrodes, the addressing electrodes are covered with a dielectric layer 12. The barriers 19 are formed between the addressing electrodes Aj, to define the discharge spaces. Between the barriers 19, the phosphor 13 having red, green, and blue light emission properties covers a corresponding one of the addressing electrodes Aj. The two substrates 11 and 14 are assembled so that the ridges of the barriers 19 are tightly in contact with the MgO film 18.

If the PDP is of a transmission type, the back glass substrate 11 is designed to display visible light emitted from the phosphor 13. If the PDP is of a reflection type, the front glass substrate 14 is designed to display reflected light from the phosphor 13. The PDP of FIGS. 3 and 4 is of the reflection type.

FIG. 5 shows waveforms used to drive the PDP of the prior art. This prior art relates to a disclosure in Japanese Unexamined Patent Publication (Kokai) No. 7-160218 corresponding to U.S. Pat. No. 5,446,344. The disclosure is based on an "addressing period/sustain discharge period separation" technique. The technique separates an addressing period for writing display data from a sustain discharge period for displaying the written data. The disclosure employs a "write addressing" technique that uses the addressing period to write display data into selected discharge cells that must emit light accordingly. In FIG. 5, the (a) portion shows a waveform for driving the addressing electrodes Aj, the (b) portion shows a waveform for driving the sustaining electrodes Xi, and the (c) to (e) portions show waveforms for driving the scanning electrodes Y1, Y2, and YN, respectively. Since the sustaining electrodes Xi are commonly connected to one another at one ends thereof, they receive the same waveform.

The waveforms of the (a) to (e) portions of FIG. 5 are for a subfield period to be explained later. Each subfield consists of a reset period, an addressing period, and a sustain discharge period.

In the reset period, a ground voltage is applied to the scanning electrodes Yi. A total write discharge pulse of Vs+Vw (about 300 V) is applied to the sustaining electrodes Xi, and a pulse of Vaw (about 100 V) is applied to the addressing electrodes Aj. As a result, total write discharge takes place in every discharge cell in every display line. The sustaining and addressing electrodes are then set to 0 V to let every discharge cell start self-erase discharge due to potential differences among wall charges accumulated with the total write discharge. After neutralizing space charges and zeroing potential differences among the electrodes, the self-erase discharge ends. The self-erase discharge eliminates the wall charges, thereby resetting and equalizing the distribution of charges among the discharge cells. Namely, the self-erase discharge initializes the discharge cells. The reset period stabilizes write discharge to be carried out in the following addressing period.

In the addressing period, a voltage of −Vsc (−50 V) is first applied to the scanning electrodes Yi, and then, a scanning pulse of −Vy (about −150V) is applied sequentially to the scanning electrodes Yi. At this time, an addressing pulse of Va (about 50 V) is applied to selected ones of the addressing electrodes Aj according to display data, and a voltage of Vx (about 50 V) is applied to the sustaining electrodes Xi. A first stage of addressing discharge takes place between the addressing electrodes Aj and the scanning electrode Yi, and just after that, a second stage of the addressing discharge takes place between the sustaining electrodes Xi and the scanning electrodes Yi, to accumulate wall charges to enable sustain discharge in the following sustain discharge period. The reason why the addressing discharge is carried out in the first and second stages is because a discharge start voltage between the addressing electrodes Aj and the scanning electrodes Yi is different from that between the sustaining electrodes Xi and the scanning electrodes Yi. The same operation is carried out through all of the display lines, to write display data into selected discharge cells, i.e., to accumulate wall charges in the selected discharge cells. This technique of carrying out write discharge in selected discharge cells that are going to display data is the "write addressing" technique. There is an "erase addressing" technique that carries out a total write operation on every discharge cell and then an erase discharge operation in unnecessary cells that do not display data.

In the sustain discharge period, a sustain discharge pulse of Vs (about 180 V) is applied alternately to the scanning electrodes Yi and sustaining electrodes Xi. The discharge cells that have accumulated wall charges due to the selective write operation in the preceding addressing period exceed a discharge start voltage because the sustain discharge pulse Vs adds potential to the wall charges, thereby causing sustain discharge in the cells. On the other hand, the discharge cells that have accumulated no wall charges because no selective write operation has been carried out therein in the preceding addressing period do not exceed the discharge start voltage with the sustain pulse of Vs, thereby causing no sustain discharge therein. Consequently, the sustain discharge makes the discharge cells where the selective write operation has been carried out in the preceding addressing period emit light.

The reset, addressing, and sustain discharge periods form a cycle. To display full-color data on the PDP, it is necessary to display gradations. To display gradations, the cycle serves as a subfield or subframe, and each frame of a screen is divided into subfields that provide different intensity levels. This is an ADS subfield technique disclosed in Japanese Unexamined Patent Publication (Kokai) No. 4-195188. The technique determines the intensity level of a given subfield according to the length of the sustain discharge period of the subfield, i.e., the number of sustain discharge pulses applied to the subfield.

FIG. 6 explains the ADS subfield technique for displaying 256 intensity levels. Each frame is divided into eight subfields SF1, SF2, SF3, SF4, SF5, SF6, SF7, and SF8. These subfields involve an identical reset period and an identical addressing period. They, however, involve different sustain discharge periods having a ratio of 1:2:4:8:16:32:64:128. In each frame, the subfields to be turned on are properly selected to display one of the 256 intensity levels ranging from 0 to 255. The ratio of the sustain discharge periods of the eight subfields of FIG. 6 is merely an example and is optionally set. There is a technique of including some subfields having an identical intensity level in a frame. In each frame, the subfields may be arranged in ascending order, in descending order, or in any other order.

An example of the time allocation of a frame will be explained. In Japan, a television image is rewritten at a frequency of 60 Hz. Accordingly, each frame lasts 16.6 ms (1/60 Hz). If each frame involves 510 sustain discharge pulses, 2 of them are in the subfield SF1, 4 in the subfield SF2, 8 in the subfield SF3, 16 in the subfield SF4, 32 in the subfield SF5, 64 in the subfield SF6, 128 in the subfield SF7, and 256 in the subfield SF8. If each sustain discharge pulse lasts 8 μs, each frame needs 4.08 ms for the 510 sustain discharge pulses. Then, the remaining about 12 ms are for the reset and addressing periods of the subfields. This means that the reset and addressing periods of each subfield must be about 1.5 ms (12 ms/8=1.5 ms). If the reset period needs about 50 μs and if the PDP involves 500 display lines, a write time for each display line in each addressing period is about 3 μs ((1.5 ms−50 μs)/500=2.9 μs).

As shown in FIG. 5, the prior art applies the total write discharge pulse of Vs+Vw (about 300 V) to the sustaining electrodes Xi in the reset period. It was found that applying the total write discharge pulse to the sustaining electrodes destabilizes a write operation in the addressing period that follows the reset period.

FIG. 7 shows waveforms for driving the PDP according to the prior art and explains the problems of the prior art. In FIG. 7, the (a) portion shows a waveform for driving the addressing electrodes Aj, the (b) portion shows a waveform for driving the sustaining electrodes Xi, and the (c) portion shows a waveform for driving the scanning electrodes Yi. The waveforms of the (a) to (c) portions are the same as those of FIG. 5. In FIG. 7, the (d) portion shows changes in the potential difference between the sustaining electrodes Xi and the scanning electrodes Yi, and the (e) portion shows changes in the potential difference between the addressing electrodes Aj and the scanning electrodes Yi. A dotted area in the (d) and the (e) portions indicates discharge caused by the potential difference.

The changes in the potential difference between the sustaining electrodes Xi and the scanning electrodes Yi of the (d) portion of FIG. 7 show that the polarity of the total write discharge pulse in the reset period is the same as that of the addressing pulse in the addressing period. If the self-erase discharge is unable to erase wall charges accumulated with the total write discharge, the remaining wall charges prevent the addressing discharge. This is the first problem shown in FIGS. 8(*a*) through 8(*c*).

The changes in the potential difference between the addressing electrodes Aj and the scanning electrodes Yi of the (e) portion of FIG. 7 show that the polarity of the total write discharge pulse in the reset period is the same as that of the addressing pulse in the addressing period. Originally, the 3-electrode surface-discharge PDP causes sustain discharge between the sustaining electrodes Xi and the scanning electrodes Yi formed on one of the substrates, and therefore, it is not easy for the prior art to erase wall charges accumulated on the addressing electrodes Aj. As a result, part of the wall charges accumulated on the addressing electrodes Aj with the addressing discharge remains even after the completion of the sustain discharge period. Since the polarity of the total write discharge pulse in the next reset period is the same as that of the addressing pulse in the addressing period, part of the remaining wall charges is not erased in the reset period, to interfere with the next addressing discharge. This is the second problem shown in FIGS. 9(*a*) through 9(*e*). The details of the first and second problems will be explained.

FIGS. 8(*a*) through 8(*c*) are models showing the total write discharge process, total self-erase discharge process, and addressing process, respectively, of the prior art and explaining the first problem of the prior art. In the total write discharge process of FIG. 8(*a*), the total write discharge pulse of Vs+Vw (about 300 V) is applied to the sustaining electrodes Xi. At this time, a voltage of, for example, 0 V is applied to the scanning electrodes Yi, and the pulse of raw (100 V) is applied to the addressing electrodes Aj. As a result, discharge occurs between the sustaining electrodes Xi and the scanning electrodes Yi, as well as between the sustaining electrodes Xi and the addressing electrodes Aj, to accumulate positive and negative wall charges on the electrodes depending on the applied voltages.

In the total self-erase discharge process of FIG. 8(*b*), 0 V is applied to all of the electrodes after the total write discharge pulse disappears. Then, self-erase discharge starts due to the potential difference between the positive and negative wall charges accumulated during the total write discharge process. The wall charges are neutralized to disappear. However, the wall charges around a gap or a counter slit between the electrodes that cause no discharge between them are not neutralized and partly remain. The counter slit is present between, for example, the first sustaining electrode X1 and the second scanning electrode Y2.

FIG. 8(*c*) shows the first problem occurring when the addressing process is carried out with the wall charges remaining. When addressing discharge is carried out, positive wall charges around the scanning electrodes Yi drop a voltage between the addressing electrodes Aj and the scanning electrodes Yi, to prevent the addressing discharge.

FIGS. 9(*a*) through 9(*e*) are models showing the addressing process, sustain discharge process, total write discharge process, total self-discharge process, and next addressing process of the prior art and explaining the second problem of the prior art. In the addressing process of FIG. 9(*a*), the voltage of Vx (50 V) is applied to the sustaining electrodes Xi, and the scanning pulse of −Vy (−150 V) is applied successively to the scanning electrodes Yi. At the same time, the addressing pulse of Va (50 V) is applied to selected ones of the addressing electrodes Aj according to display data, to carry out addressing discharge. This accumulates wall charges on the sustaining and scanning electrodes of each discharge cell to which data is to be written. The wall charges effectively act when sustain discharge is carried out between the sustaining and scanning electrodes of the cell later. During the addressing process, the addressing electrodes Aj used to select the discharge cells inevitably accumulate negative wall charges. The PDP of FIG. 2 forms the barriers 19 for spatially separating the discharge cells only along the addressing electrodes Aj, and therefore, the wall charges produced with the addressing discharge spread along the addressing electrodes Aj.

The sustain discharge process of FIG. 9(*b*) applies sustain discharge pulses additively to the wall charges that have been accumulated during the addressing process of FIG. 9(*a*) on the sustaining electrodes Xi and scanning electrodes Yi. Accordingly, sustain discharge occurs only between the sustaining electrodes Xi and the scanning electrodes Yi formed on one of the substrates, and therefore, the wall charges accumulated on the addressing electrodes Aj are hardly neutralized. In particular, the wall charges accumulated around the counter slits adjacent to the addressing electrodes Aj are away from discharge spaces between the sustaining electrodes Xi and the scanning electrodes Yi, and therefore, tend to remain even after the completion of the sustain discharge process.

Even after the total write discharge process of FIG. 9(*c*) and total self-erase discharge process of FIG. 9(*d*) in the next subframe, the wall charges around the counter slits adjacent to the addressing electrodes Aj remain. This is because the polarity of the potential difference between the addressing electrodes Aj and the scanning electrodes Yi is unchanged between the total write discharge process and the addressing process.

Generally, wall charges accumulated by discharge produced with a voltage having a given polarity are completely neutralized only by discharge produced with the same magnitude of voltage having an opposite polarity. When the total write discharge process of FIG. 9(*c*) applies a voltage having the same polarity as that of the addressing process of FIG. 9(*a*), the negative wall charges remaining around the addressing electrodes Aj drop the voltage applied in the total write discharge process between the addressing electrodes Aj and the scanning electrodes Yi. Since the voltage applied between the addressing electrodes Aj and the scanning electrodes Yi is low, for example, about 100 V in the total write discharge process, there will be no discharge between the addressing electrodes Aj and the scanning electrodes Yi. In this case, discharge mainly occurs between the addressing electrodes Aj and the sustaining electrodes Xi between which a high voltage is applied as shown in FIG. 9(*c*). The wall charges remaining around the counter slits along the addressing electrodes Aj are too far from discharge spaces between the addressing electrodes Aj and the sustaining electrodes Xi. As a result, the wall charges around the counter slits along the addressing electrodes Aj are not completely neutralized even through the total write discharge process of FIG. 9(*c*) and the total self-erase discharge process of FIG. 9(*d*).

The next addressing process of FIG. 9(*e*) applies the addressing pulse of Va (50 V) to selected ones of the addressing electrodes Aj. At this time, the negative wall charges remaining along the addressing electrodes Aj drop the voltage applied between the addressing electrodes Aj and the scanning electrodes Yi in the addressing process of FIG. 9(*e*). This results in no addressing discharge beginning in some of the discharge cells.

It has been known that such remaining wall charges cause a drop of an originally applied voltage by about 10 V, reducing the expected discharge. Namely, the remaining wall charges result in an applied voltage to not reach a required discharge start voltage, thereby producing no discharge. In this way, the prior art is unable to stably carry out addressing discharge. Due to this, the prior art causes write errors to incorrectly display data. To cope with the remaining wall charges, there has been proposed an idea to apply a large voltage to the electrodes. This, however, increases power consumption.

SUMMARY OF THE INVENTION

An object of the present invention is to provide a method of, and an apparatus for, driving a plasma display panel, capable of stably carrying out addressing discharges by completely eliminating residual wall charges without increasing power consumption.

In order and accomplish the object, the present invention provides a method of driving a plasma displayed panel having a first substrate, first and second electrodes formed on the first substrate, each pair of the first and second electrodes extending in parallel with each other and corresponding to a display line, a second substrate facing the first substrate, third electrodes formed on one of the first and second substrates orthogonal to and electrically separate from the first and second electrodes, and discharge cells formed at intersections of the first and second electrodes and the third electrodes. The method includes a reset period for applying predetermined voltages to the first, second, and third electrodes, respectively, to carry out reset discharge in the discharge cells and accumulate wall charges so that the potential difference among the wall charges may achieve self-erase discharge to equalize the distribution of charges among the discharge cells, an addressing period for carrying out selective discharge with the second and third electrodes in selected ones of the discharge cells, to write display data into the selected discharge cells, and a sustain discharge period for applying sustain discharge pulses to the first and second electrodes, to let the selected discharge cells discharge and emit light. The polarity of the potential difference between the first and second electrodes in the reset period is opposite to the polarity of the potential difference between the first and second electrodes in the addressing period.

Alternatively, the present invention provides a method of driving a plasma display panel having a first substrate, first and second electrodes formed on the first substrate, each pair of the first and second electrodes extending in parallel with each other and corresponding to a display line, a second substrate facing the first substrate, third electrodes formed on one of the first and second substrates orthogonal to and electrically separate from the first and second electrodes, and discharge cells formed at intersections of the first and second electrodes and the third electrodes. The method includes a reset period for applying predetermined voltages to the first, second, and third electrodes, respectively, to carry out reset discharge in the discharge cells and accumulate wall charges so that the potential difference among the wall charges may achieve self-erase discharge to equalize the distribution of charges among the discharge cells, an addressing period for carrying out selective discharge with the second and third electrodes in selected ones of the discharge cells, to write display data into the selected discharge cells, and a sustain discharge period for applying sustain discharge pulses to the first and second electrodes, to let the selected discharge cells discharge and emit light. The polarity of the potential difference between the second and third electrodes in the reset period is opposite to the polarity of the potential difference between the second and third electrodes in the addressing period.

Preferably, the method of driving the plasma display panel according to the present invention realizes the reset discharge by applying a first pulse having a first polarity to the first electrodes and a second pulse having a second polarity to the second electrodes.

More preferably, the method of driving the plasma display panel according to the present invention makes the polarity of the potential difference between the first and third electrodes in the reset period be opposite to the polarity of the potential difference between the first and third electrodes in the addressing period.

More preferably, the method of driving the plasma display panel according to the present invention applies a first auxiliary pulse having the same magnitude as the sustain discharge pulse to the first or second electrodes after the completion of the self-erase discharge and before the selective discharge to be carried out in the addressing period.

More preferably, the method of driving the plasma display panel according to the present invention applies a second auxiliary pulse having the same magnitude as a pulse applied to the second electrodes in the addressing period to achieve the selective discharge, to the second or first electrodes after the completion of the self-erase discharge and before the selective discharge to be carried out in the addressing period.

On the other hand, the present invention provides an apparatus for driving a plasma display panel having a first substrate, first and second electrodes formed on the first substrate, each pair of the first and second electrodes extending in parallel with each other and corresponding to a display line, a second substrate facing the first substrate, third electrodes formed on one of the first and second substrates orthogonal to and electrically separate from the first and second electrodes, and discharge cells formed at intersections of the first and second electrodes and the third electrodes. The apparatus repeats a reset period for applying predetermined voltages to the first, second, and third electrodes, respectively, to carry out reset discharge in the discharge cells and accumulate wall charges so that the potential difference among the wall charges may achieve self-erase discharge to equalize the distribution of charges among the discharge cells, an addressing period for carrying out selective discharge with the second and third electrodes in selected ones of the discharge cells, to write display data into the selected discharge cells, and a sustain discharge period for applying sustain discharge pulses to the first and second electrodes, to let the selected discharge cells discharge and emit light. The apparatus has circuits for driving the first, second, and third electrodes so that the polarity of the potential difference between the first and second electrodes in the reset period is opposite to the polarity of the potential difference between the first and second electrodes in the addressing period.

Alternatively, the present invention provides an apparatus for driving a plasma display panel having a first substrate, first and second electrodes formed on the first substrate, each pair of the first and second electrodes extending in parallel with each other and corresponding to a display line, a second substrate facing the first substrate, third electrodes formed on one of the first and second substrates orthogonal to and electrically separate from the first and second electrodes, and discharge cells formed at intersections of the first and second electrodes and the third electrodes. The apparatus repeats a reset period for applying predetermined voltages to the first, second, and third electrodes, respectively, to carry out reset discharge in the discharge cells and accumulate wall charges so that the potential difference among the wall charges may achieve self-erase discharge to equalize the distribution of charges among the discharge cells, an addressing period for carrying out selective discharge with the second and third electrodes in selected ones of the discharge cells, to write display data into the selected discharge cells, and a sustain discharge period for applying sustain discharge pulses to the first and second electrodes, to let the selected discharge cells discharge and emit light. The apparatus has circuits for driving the first, second, and third electrodes so that the polarity of the potential difference between the second and third electrodes in the reset period is opposite to the polarity of the potential difference between the second and third electrodes in the addressing period.

Preferably, in the apparatus for driving the plasma display panel according to the present invention, the circuit for driving the first electrodes has a first push-pull-type switching element pair for providing the first electrodes with the sustain discharge pulses, a second push-pull-type switching element pair for providing the first electrodes with a voltage in the addressing period, and a third switching element for providing the first electrodes with the predetermined voltage to achieve the reset discharge.

More preferably, in the apparatus for driving the plasma display panel according to the present invention, the first and second switching element pairs are connected to the first electrodes and the third switching element through a fourth switching element.

The method of, and apparatus for, driving the plasma display panel according to the present invention are capable of correctly carrying out addressing discharge even if wall charges accumulated with the reset discharge remain after the self-erase discharge.

Even if wall charges accumulated with the addressing discharge remain, the method and apparatus of the present invention are capable of neutralizing the remaining wall charges in the next reset period, to correctly carry out the next addressing discharge.

BRIEF DESCRIPTION OF THE DRAWINGS

The above objects and features of the present invention will be more apparent from the following description of some preferred embodiments with reference to the accompanying drawings, wherein.

DESCRIPTION OF THE PREFERRED EMBODIMENTS

Hereinafter, the description of some preferred embodiments according to the present invention will be given with reference to the accompanying drawings.

Figure 10:
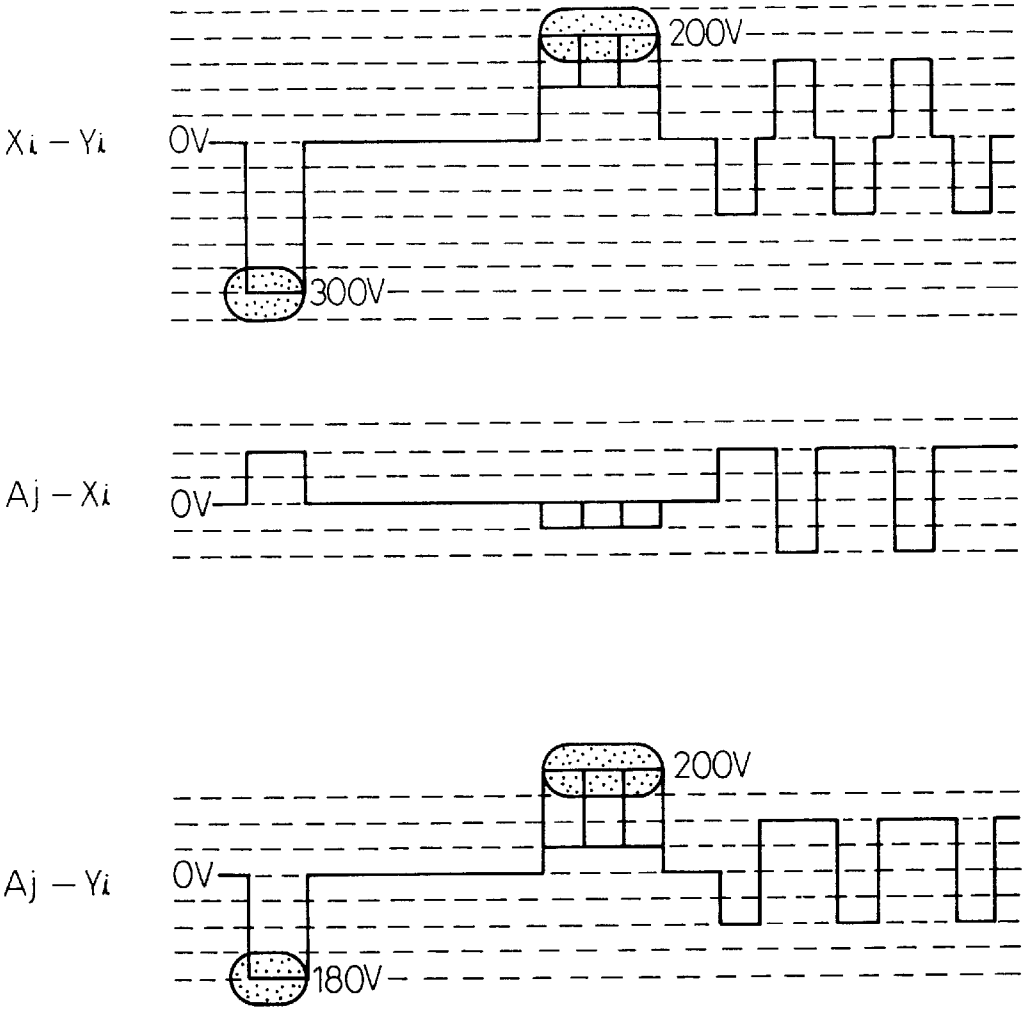
FIG. 10 shows models of waveforms for driving a plasma display panel according to the principle of the present invention.

FIG. 10 shows models of waveforms for driving a plasma display panel according to the principle of the present invention.

Figure 1:
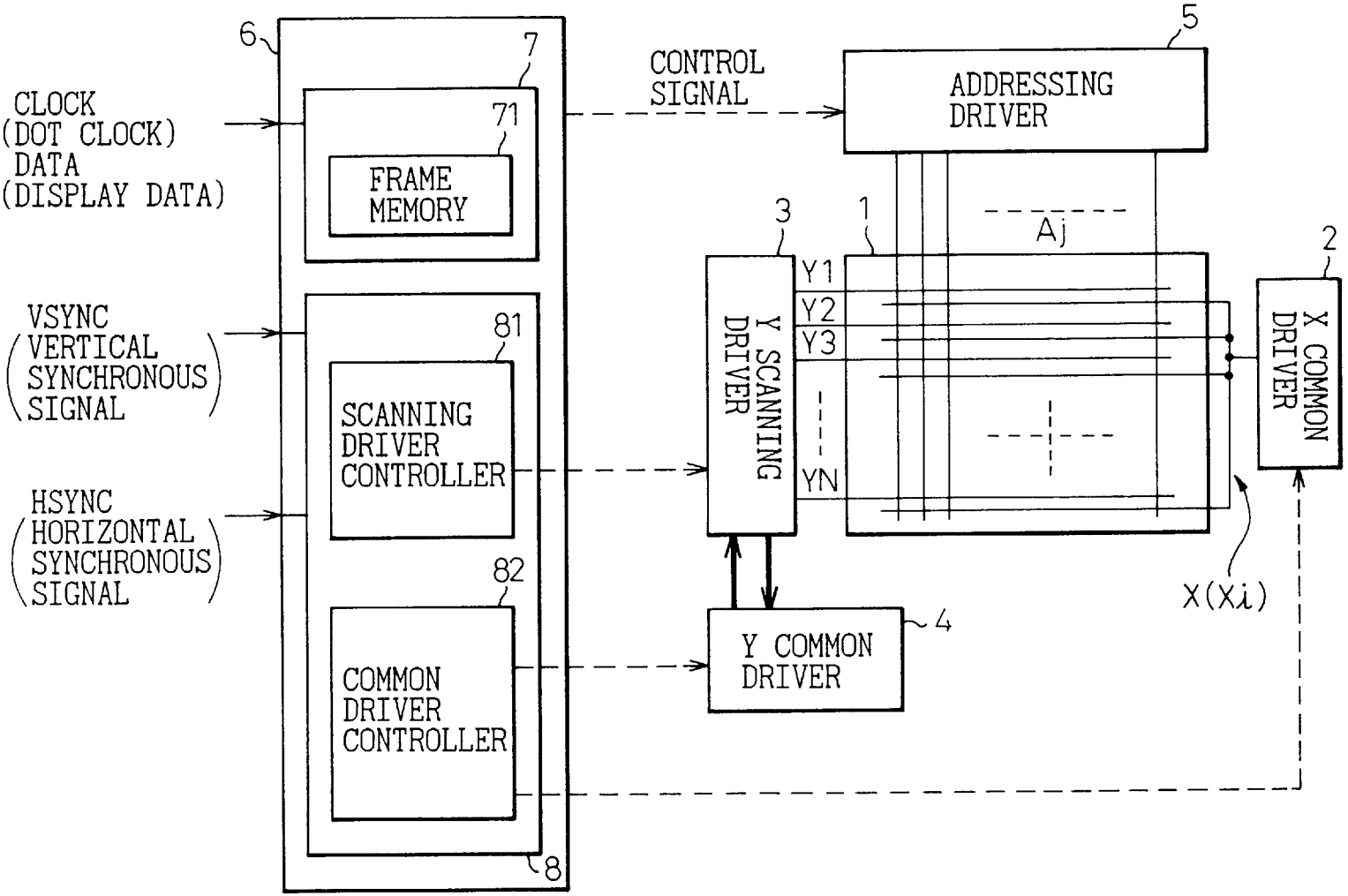
FIG. 1 is a block diagram schematically showing peripheral circuits for driving a 3-electrode surface-discharge AC-type plasma display panel according to a prior art system.
Figure 2:
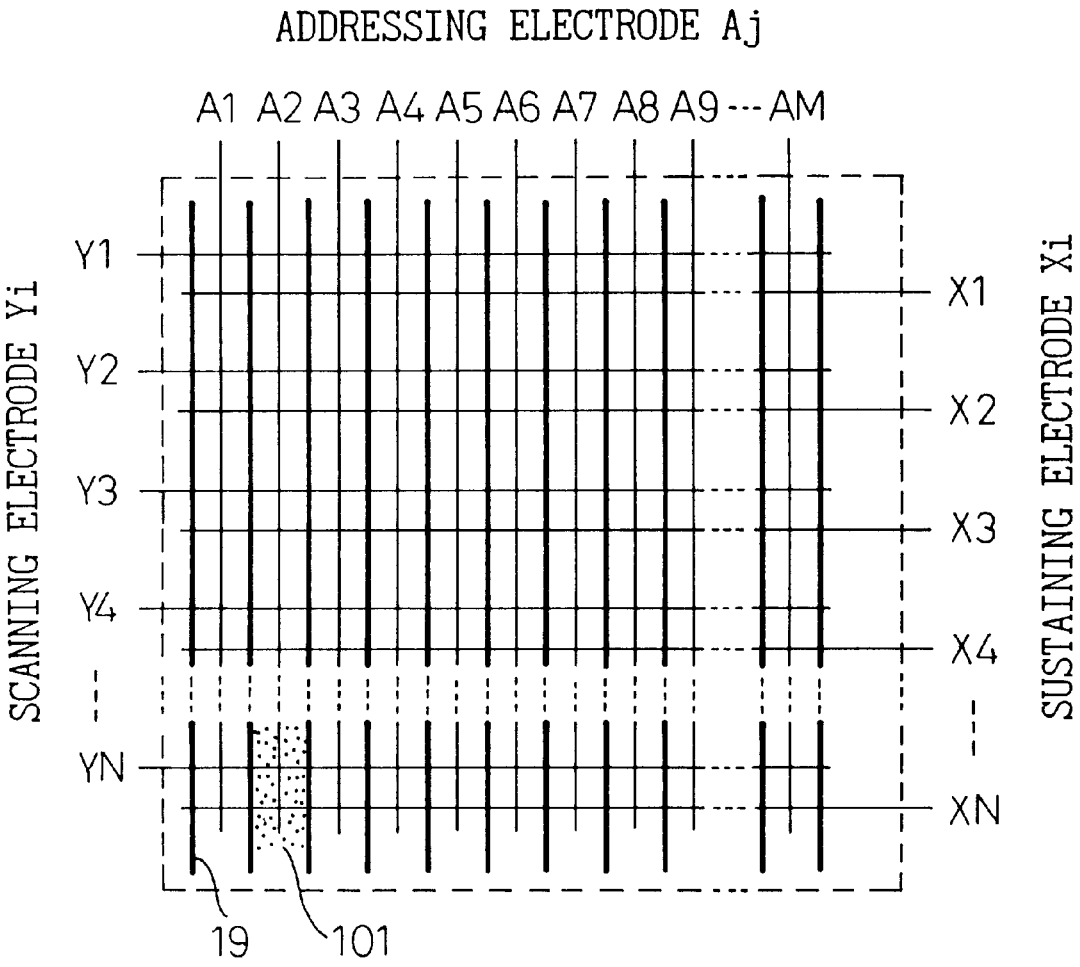
FIG. 2 is a plan view schematically showing the plasma display panel of FIG. 1.
Figure 3:
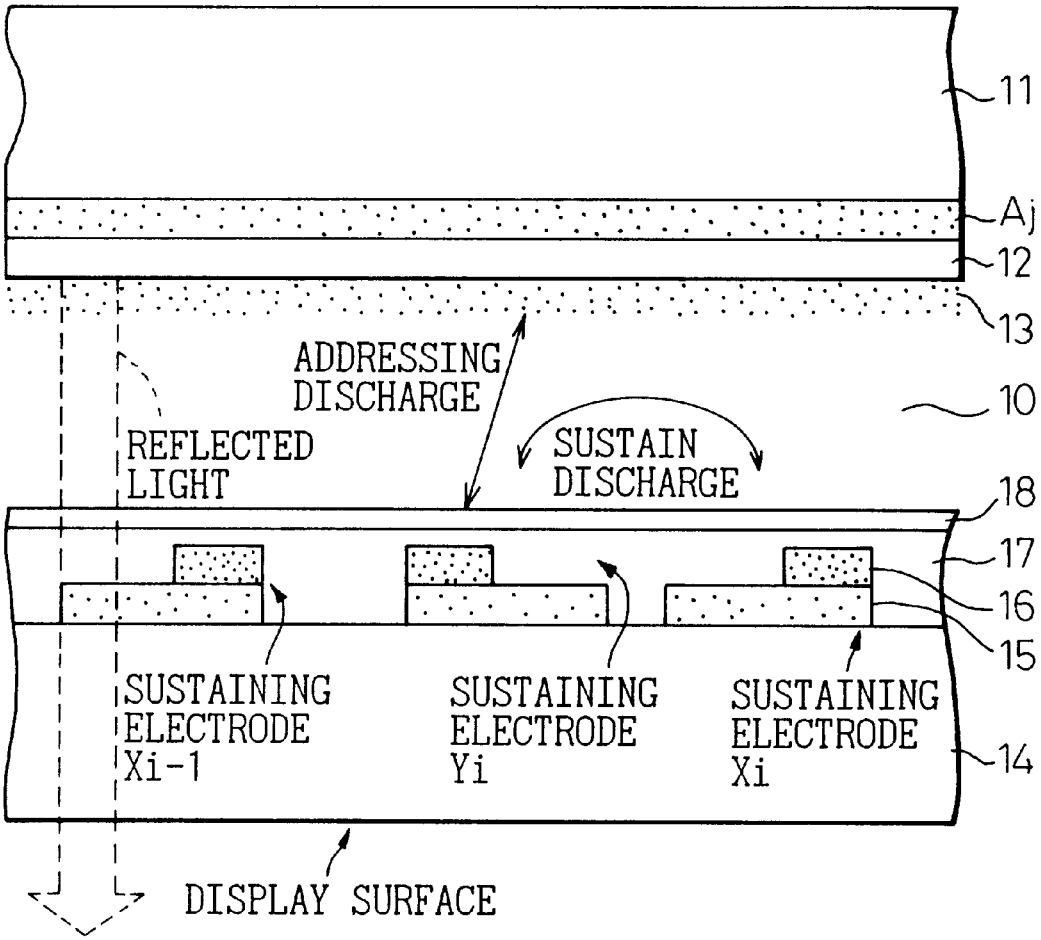
FIG. 3 is a first sectional view schematically showing the plasma display panel of FIG. 2.
Figure 4:
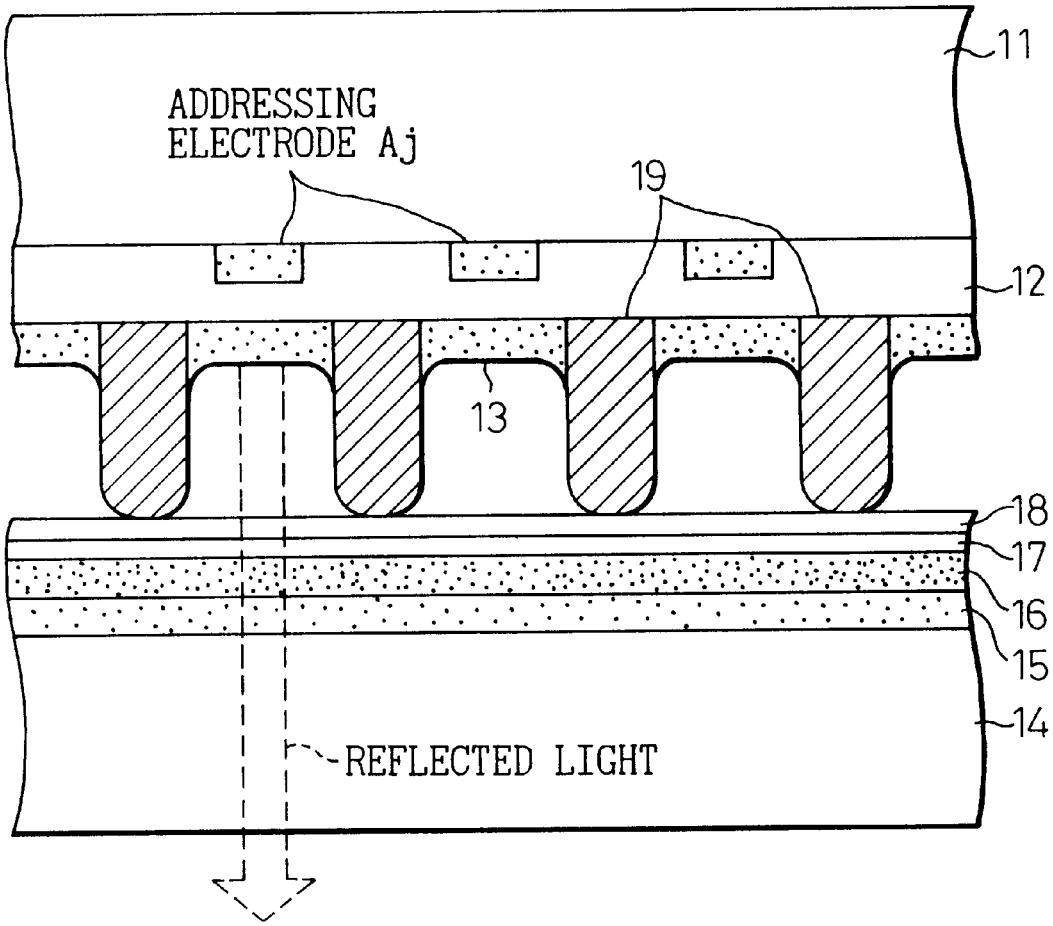
FIG. 4 is a second sectional view schematically showing the plasma display panel of FIG. 2.
Figure 5:
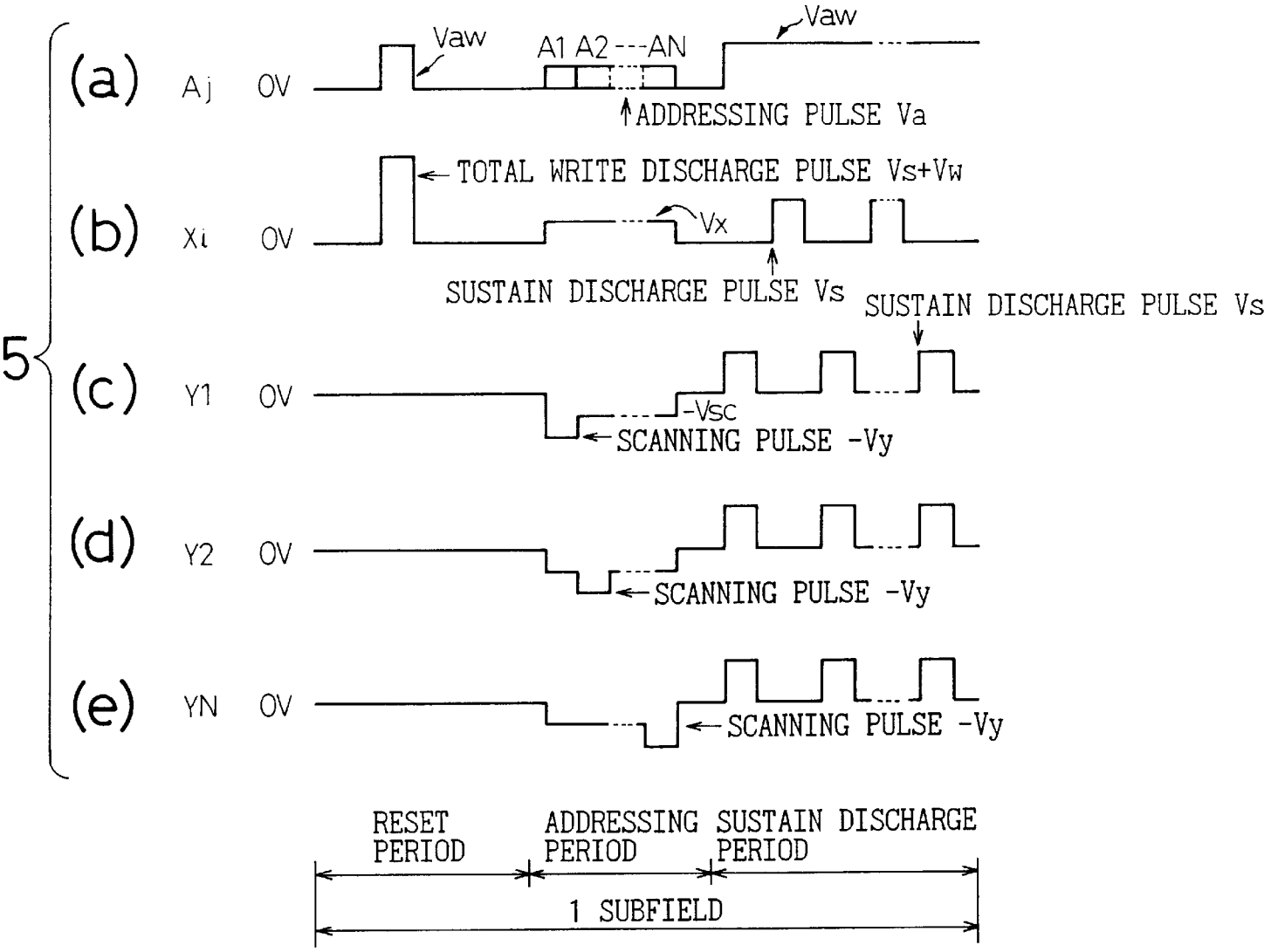
FIG. 5 shows waveforms for driving the plasma display panel according to the prior art.
Figure 6:
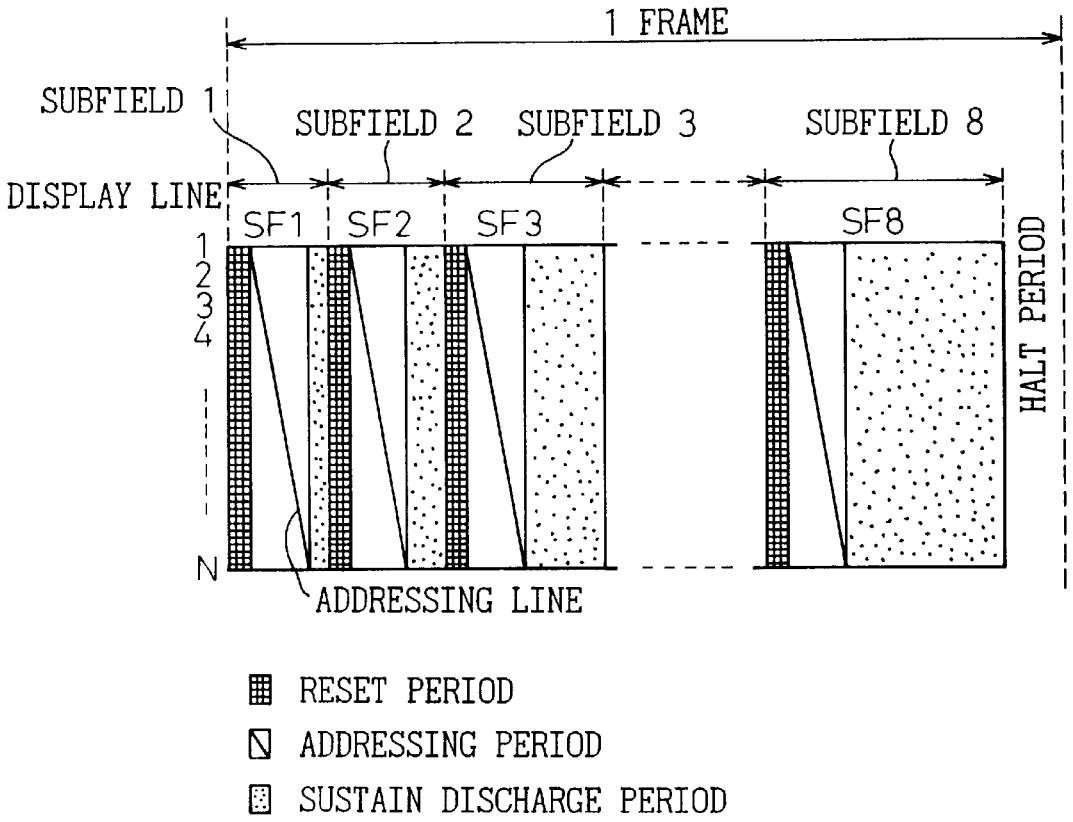
FIG. 6 explains a standard ADS subfield method.
Figure 15:
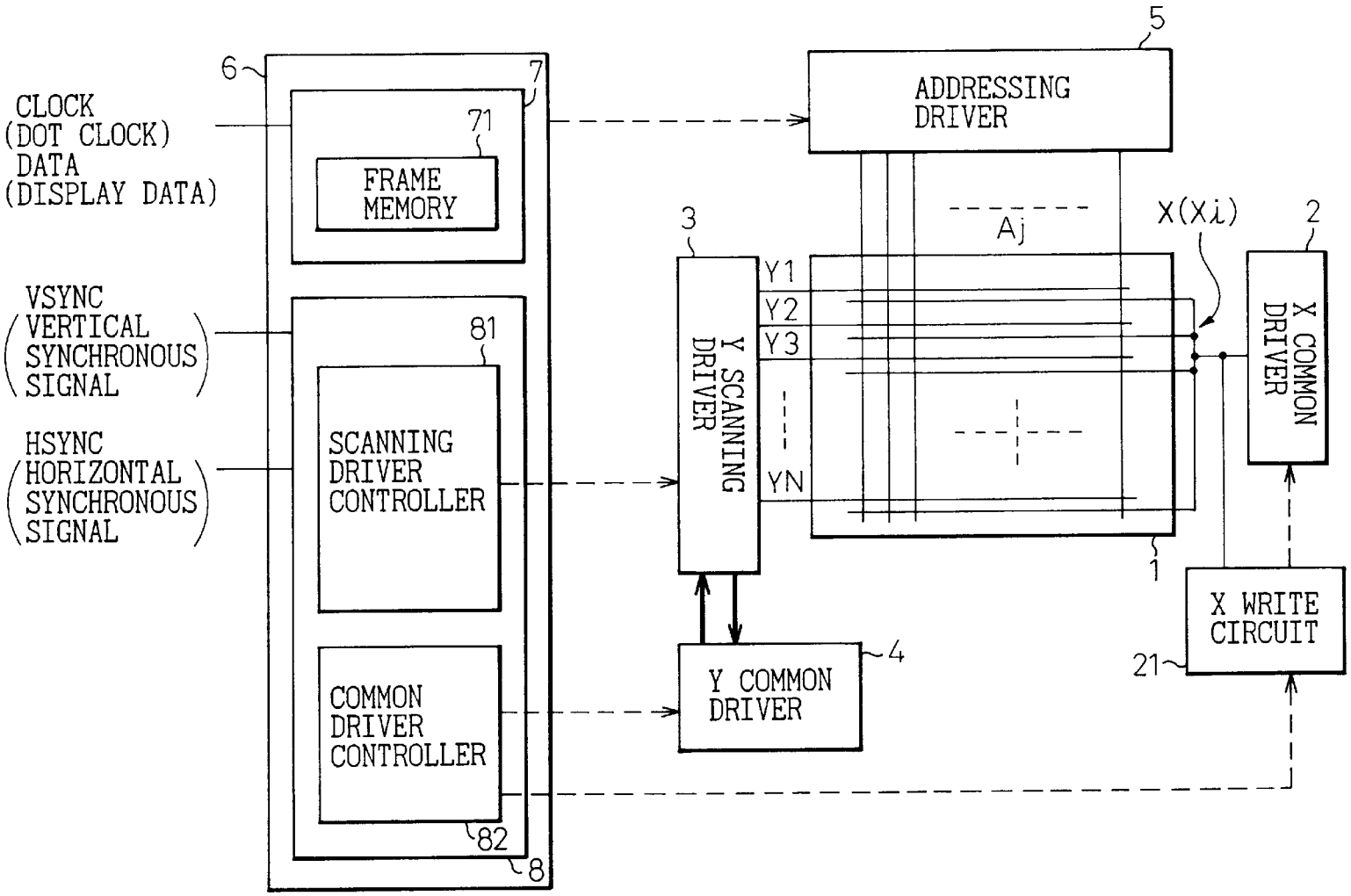
FIG. 15 is a block diagram schematically showing a circuit for driving a plasma display panel according to a third embodiment of the present invention.

The plasma display panel to which the present invention is applicable may be the one shown in FIG. 1 or the one shown in FIG. 15. The plasma display panel has a first substrate, first electrodes (sustaining electrodes Xi) and second electrodes (scanning electrodes Yi) formed on the first substrate, each pair of the first and second electrodes extending in parallel with each other and corresponding to a display line, a second substrate facing the first substrate, third electrodes (addressing electrodes Aj) formed on one of the first and second substrates orthogonal to and electrically separate from the first and second electrodes (Xi, Yi), and discharge cells formed at intersections of the first and second electrodes (Xi, Yi) and the third electrodes (Aj). A method of driving the plasma display panel according to the present invention includes a reset period for applying predetermined voltages to the first, second, and third electrodes (Xi, Yi, Aj), respectively, to carry out reset discharge in the discharge cells and accumulate wall charges so that the potential difference among the wall charges may achieve self-erase discharge to equalize the distribution of charges among the discharge cells, an addressing period for carrying out selective discharge with the second and third electrodes (Yi, Aj) in selected ones of the discharge cells, to write display data into the selected discharge cells, and a sustain discharge period for applying sustain discharge pulses to the first and second electrodes (Xi, Yi), to let the selected discharge cells discharge and emit light. The polarity of the potential difference between the first and second electrodes (Xi, Yi) in the reset period is opposite to the polarity of the potential difference between the first and second electrodes (Xi, Yi) in the addressing period.

According to the present invention, the polarity of the potential difference between the second and third electrodes (Yi, Aj) in the reset period may be opposite to the polarity of the potential difference between the second and third electrodes (Yi, Aj) in the addressing period.

FIG. 10 shows the potential differences among the first to third electrodes. In the figure, the (a) portion shows the potential difference between the first and second electrodes (Xi, Yi), the (b) portion shows the potential difference between the third and first electrodes (Aj, Xi), and the (c) portion shows the potential difference between the third and second electrodes (Aj, Yi).

In the (a) portion of FIG. 10, the polarity of total write discharge between the first and second electrodes in the reset period is opposite to the polarity of addressing discharge between the same electrodes in the addressing period. In the (c) portion of FIG. 10, the polarity of total write discharge between the third and second electrodes in the reset period is opposite to the polarity of addressing discharge between the same electrodes in the addressing period.

As explained above, the addressing discharge is destabilized if the polarity of the total write discharge between related electrodes in the reset period is the same as the polarity of the addressing discharge between the same electrodes in the addressing period. The method of the present invention solves this problem, eliminates residual wall charges, and stabilizes the addressing discharge without increasing power consumption.

Preferably, the method of the present invention realizes the reset discharge by applying a first pulse having a first polarity to the first electrodes (Xi) and a second pulse having a second polarity to the second electrodes (Yi).

More preferably, the method of the present invention makes the magnitude of one of the first and second pulses equal to the magnitude of the sustain discharge pulse.

More preferably, the method of the present invention sets the width of each of the first and second pulses to a valve in the range from 5 $\mu$s to 10 $\mu$s.

More preferably, the method of the present invention applies a gently rising erase discharge pulse to one of the first and second electrodes (Xi, Yi) just before the reset discharge takes place.

More preferably, the method of the present invention makes the gently rising erase discharge pulse gently rise up to the level of one of the first and second pulses and is integrated with the same.

More preferably, the method of the present invention applies a ground voltage to the third electrodes (Aj) during the reset period.

More preferably, the method of the present invention makes the polarity of the potential difference between the first and third electrodes (Xi, Aj) in the reset period be opposite to the polarity of the potential difference between the first and third electrodes (Xi, Aj) in the addressing period.

More preferably, the method of the present invention applies a first auxiliary pulse having the same magnitude as the sustain discharge pulse to the first or second electrodes (Xi or Yi) after the completion of the self-erase discharge and before the selective discharge to be carried out in the addressing period.

More preferably, the method of the present invention forms the first auxiliary pulse with a positive pulse and applies the same to the first electrodes (Xi) while the second electrodes (Yi) are receiving a ground voltage and the third electrodes (Aj) are receiving a positive pulse that is lower than the sustain discharge pulse.

More preferably, the method of the present invention applies a gently rising auxiliary erase discharge pulse to one of the second and first electrodes (Yi, Xi) after the application of the first auxiliary pulse and before the selective discharge to be carried out in the addressing period.

More preferably, the method of the present invention applies a second auxiliary pulse having the same magnitude as a pulse applied to the second electrodes (Yi) in the addressing period to achieve the selective discharge, to the second or first electrodes (Yi or Xi) after the completion of the self-erase discharge and before the selective discharge to be carried out in the addressing period.

More preferably, the method of the present invention forms the second auxiliary pulse with a negative pulse and applies the same to the second electrodes (Yi) while the third electrodes (Aj) are receiving a ground voltage and the first electrodes (Xi) are receiving the ground voltage or the voltage applied to the first electrodes (Xi) during the selective discharge in the addressing period.

More preferably, the method of the present invention applies a gently rising auxiliary erase discharge pulse to one of the second and first electrodes (Yi, Xi) after the application of the second auxiliary pulse and before the selective discharge to be carried out in the addressing period.

On the other hand, an apparatus based on the principle of FIG. 10 of the present invention drives a plasma display panel having a first substrate, first and second electrodes (Xi, Yi) formed on the first substrate, each pair of the first and second electrodes extending in parallel with each other and corresponding to a display line, a second substrate facing the first substrate, third electrodes (Aj) formed on one of the first and second substrates orthogonal to and electrically separate from the first and second electrodes (Xi, Yi), and discharge cells formed at intersections of the first and second electrodes and the third electrodes. The apparatus repeats a reset period for applying predetermined voltages to the first, second, and third electrodes (Xi, Yi, Aj), respectively, to carry out reset discharge in the discharge cells and accumulate wall charges so that the potential difference among the wall charges may achieve self-erase discharge to equalize the distribution of charges among the discharge cells, an addressing period for carrying out selective discharge with the second and third electrodes (Yi, Aj) in selected ones of the discharge cells, to write display data into the selected discharge cells, and a sustain discharge period for applying sustain discharge pulses to the first and second electrodes (Xi, Yi), to let the selected discharge cells discharge and emit light. The apparatus has circuits for driving the first, second, and third electrodes (Xi, Yi, Aj) so that the polarity of the potential difference between the first and second electrodes (Xi, Yi) in the reset period is opposite to the polarity of the potential difference between the first and second electrodes (Xi, Yi) in the addressing period.

Alternatively, in the apparatus for driving the plasma display panel according to the present invention, the circuits for driving the first, second, and third electrodes (Xi, Yi, Aj) may control these electrodes so that the polarity of the potential difference between the second and third electrodes (Yi, Aj) in the reset period is opposite to the polarity of the potential difference between the second and third electrodes (Yi, Aj) in the addressing period.

The apparatus of the present invention eliminates residual wall charges and stabilizes the addressing discharge without increasing power consumption.

Preferably, in the apparatus of the present invention, the circuit for driving the first electrodes (Xi) has a first push-pull-type switching element pair for providing the first electrodes with the sustain discharge pulses, a second push-pull-type switching element pair for providing the first electrodes with a voltage in the addressing period, and a third switching element for providing the first electrodes with the predetermined voltage to achieve the reset discharge.

More preferably, in the apparatus of the present invention, the first and second switching element pairs are connected to the first electrodes (Xi) and third switching element through a fourth switching element.

Figure 11:
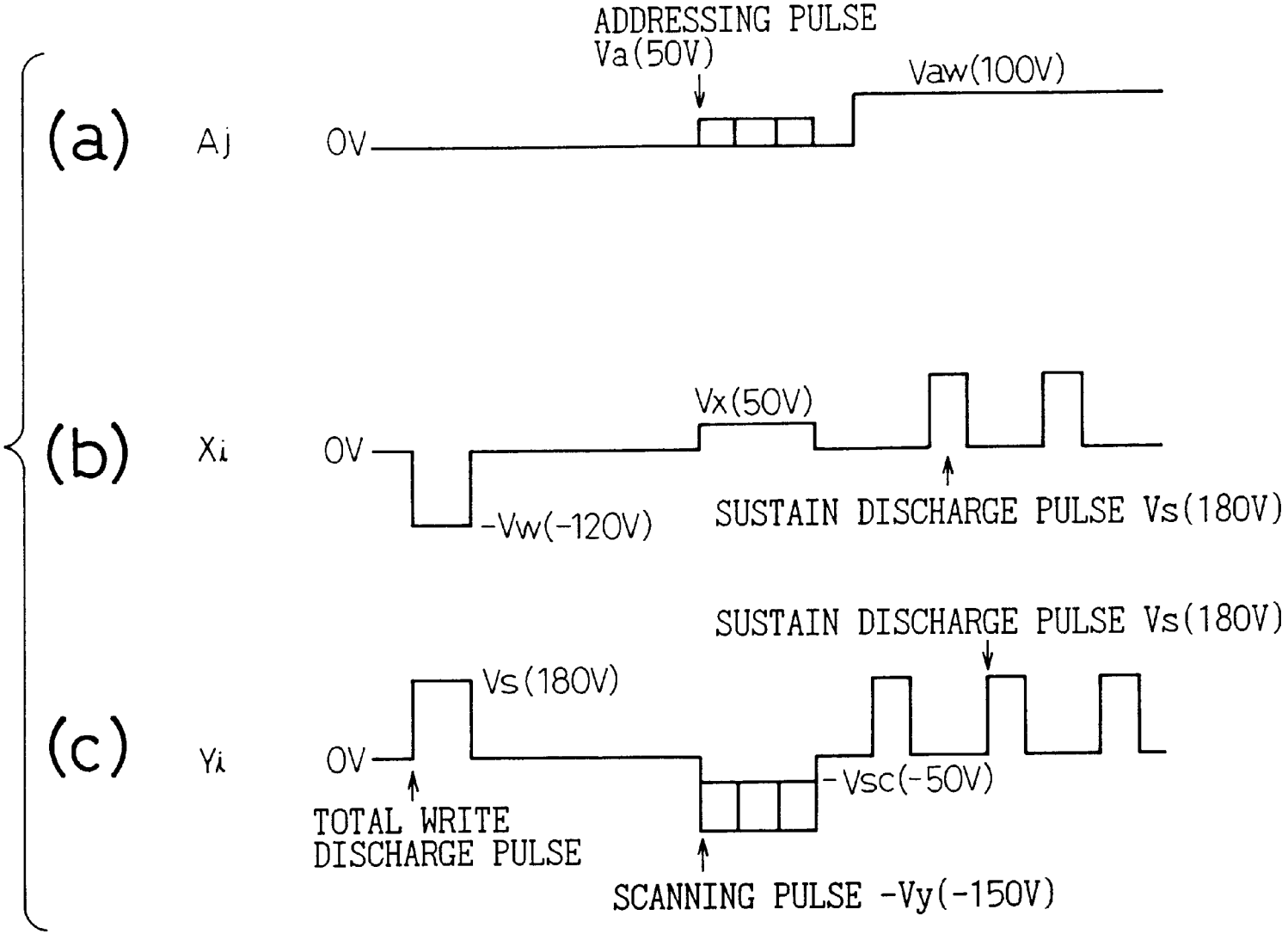
FIG. 11 shows waveforms for driving a plasma display panel according to a first embodiment of the present invention.

FIG. 11 shows waveforms for driving a plasma display panel according to the first embodiment of the present invention. In the figure, the (a) portion shows a voltage waveform applied to the addressing electrodes Aj, the (b) portion shows a voltage waveform applied to the sustaining electrodes Xi, and the (c) portion shows a voltage waveform applied to the scanning electrode Yi. As shown in FIG. 1, the sustaining electrodes Xi are commonly connected to receive the same voltage. Some plasma display panels group the sustaining electrodes Xi into blocks and connect them group by group. The present invention is applicable to this kind of plasma display panel.

Figure 7:
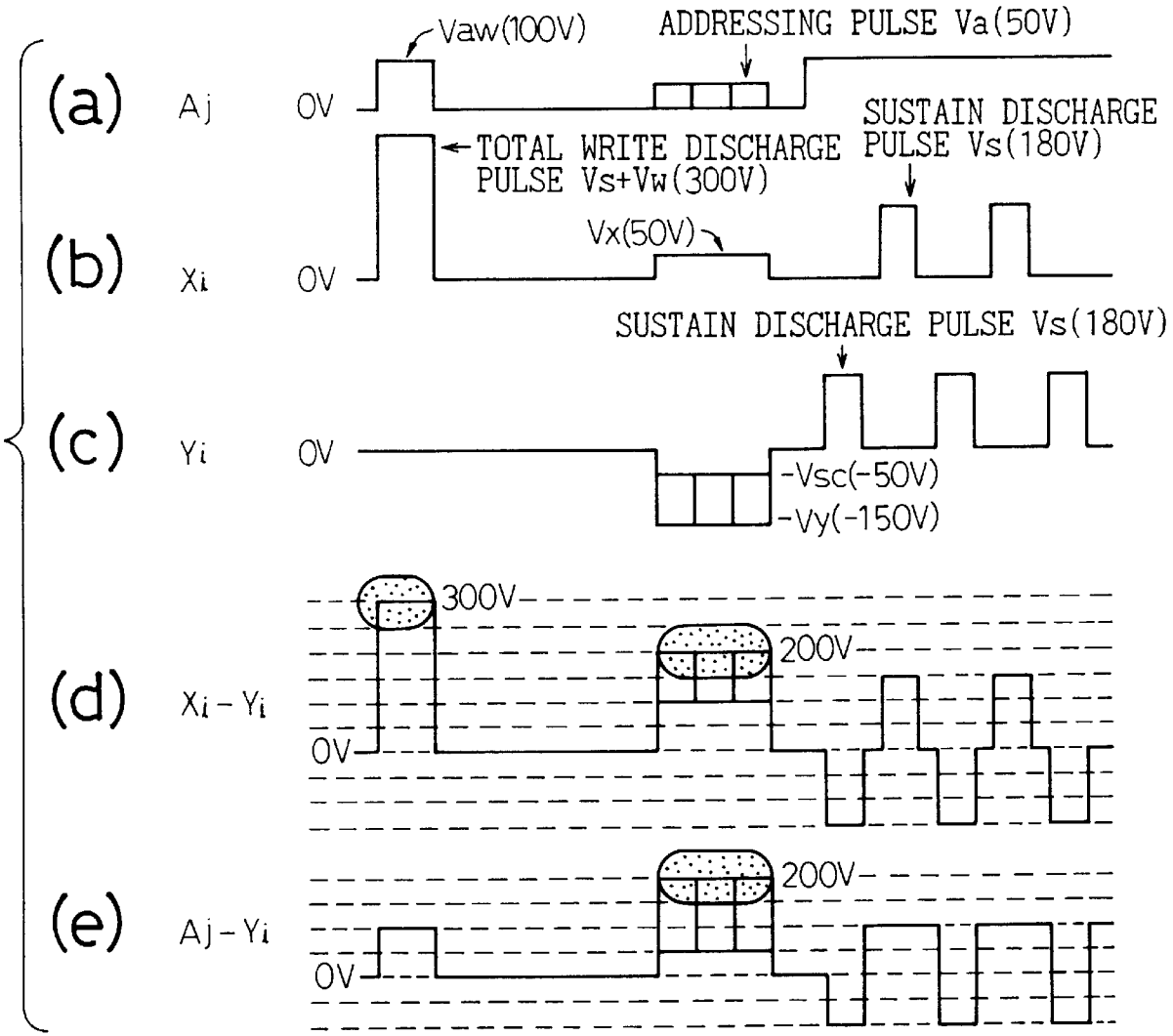
FIG. 7 shows waveforms explaining the problems of the prior art.
Figure 8A:
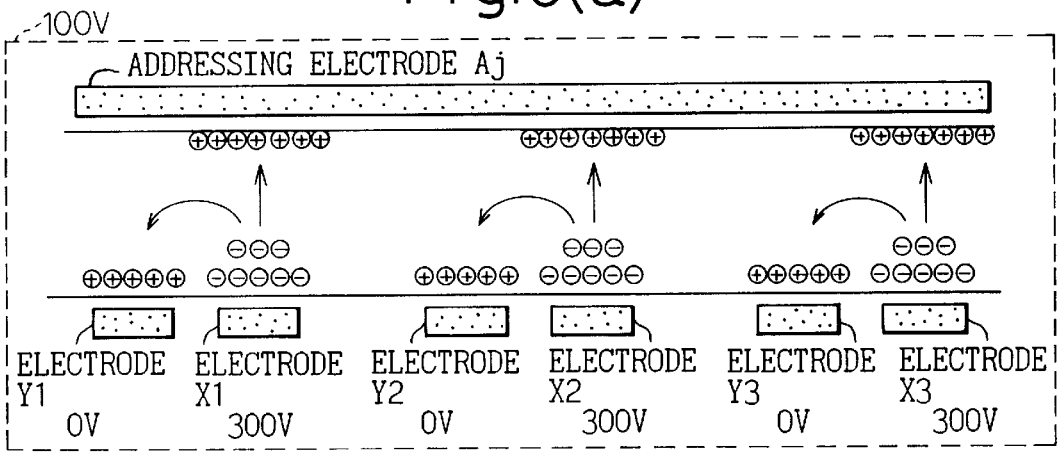
FIGS. 8(*a*) through 8(*c*) are models showing a total write discharge process, a total self-erase discharge process, and an addressing process, respectively, according to the prior art and explaining the first problem of the prior art.
Figure 8B:
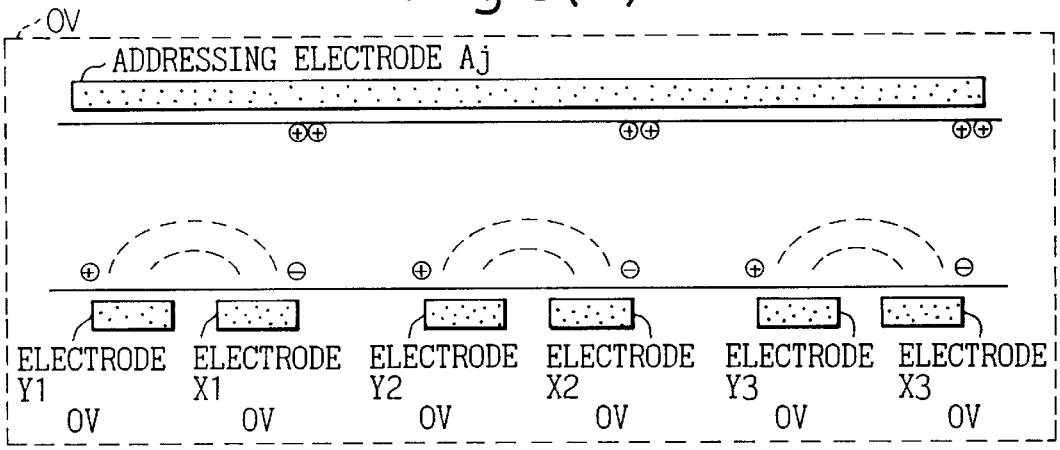
Figure 8C:
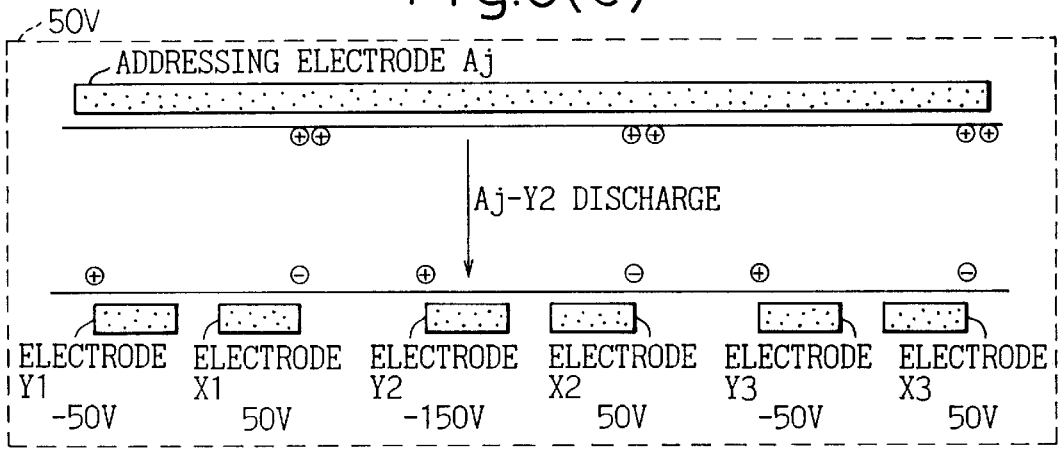
Figure 9A:
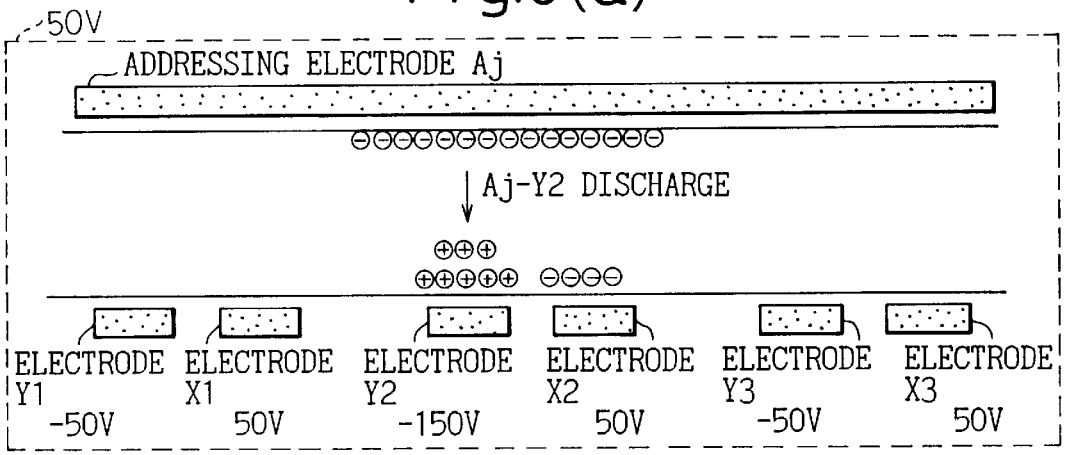
FIGS. 9(*a*) through 9(*e*) are models showing an addressing process, a sustain discharge process, a total write discharge process, a total self-discharge process, and the next addressing process according to the prior art and explaining the second problem of the prior art.
Figure 9B:
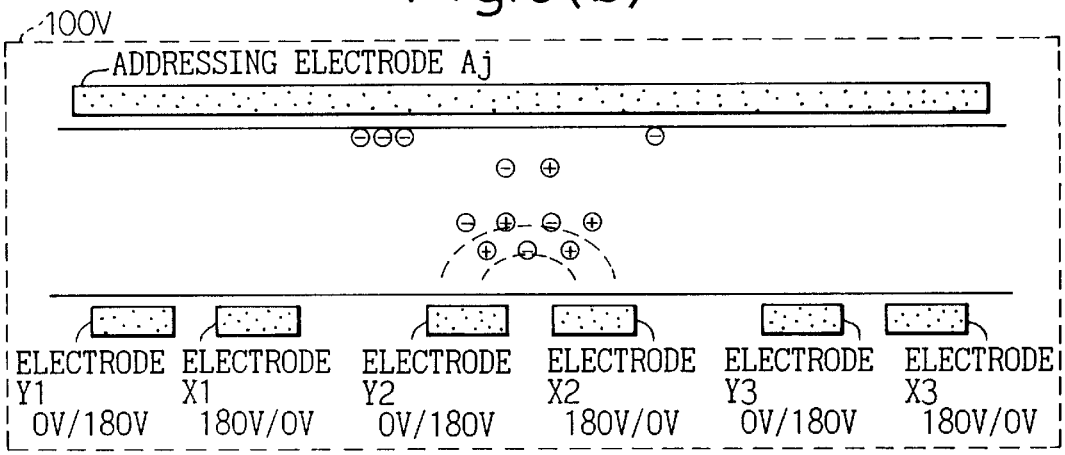
Figure 9C:
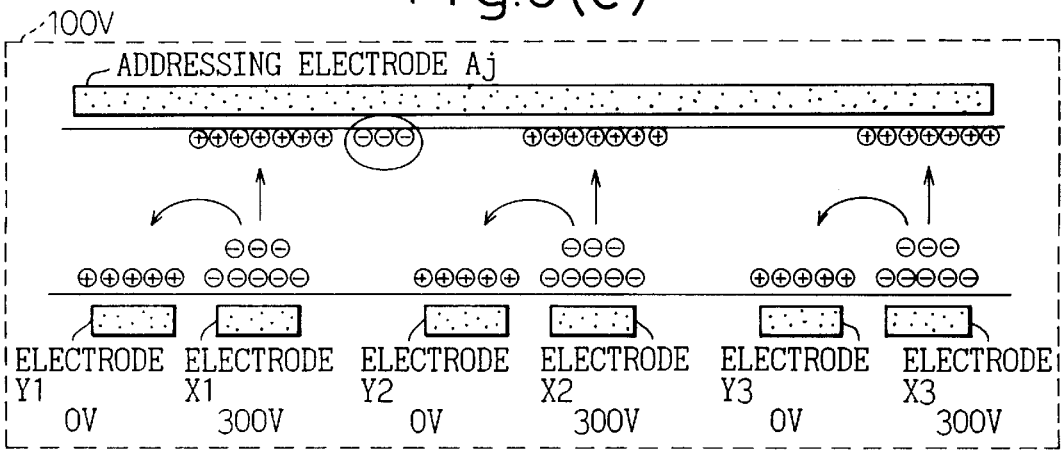
Figure 9D:
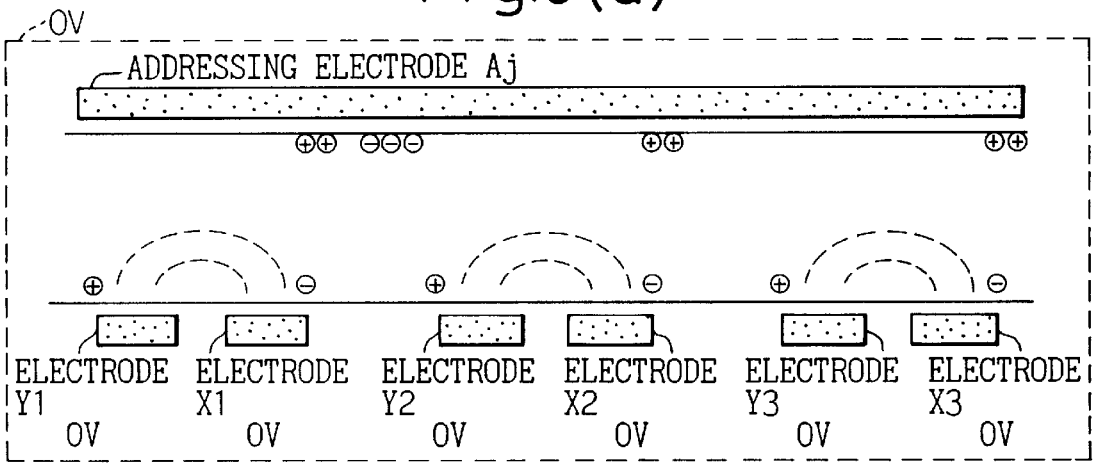
Figure 9E:
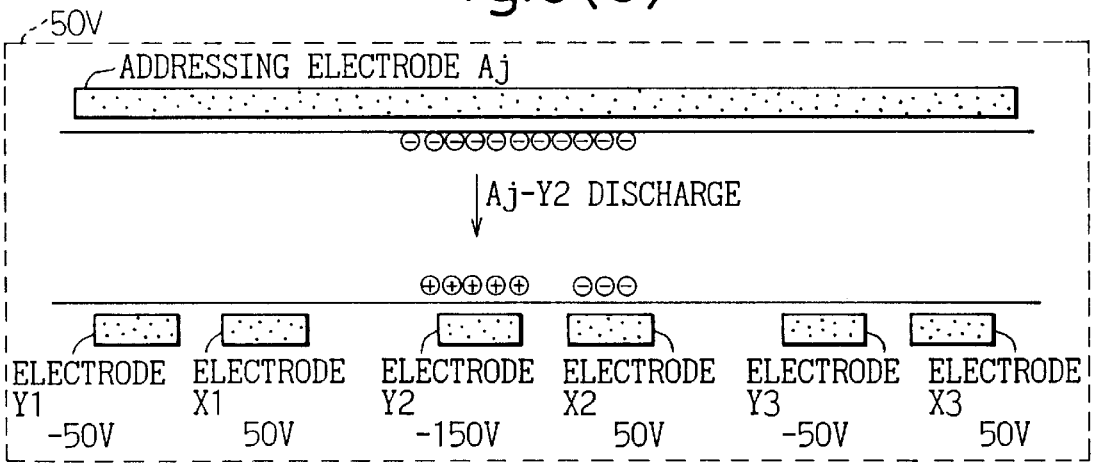

In the reset period, all addressing electrodes Aj are kept at 0 V, and a total write discharge pulse of −Vw (−120 V) is applied to all sustaining electrodes Xi, and a total write discharge pulse of Vs (+180 V) is applied to all scanning electrodes Yi. As a result, a voltage of 300 V acts between the sustaining electrodes Xi and the scanning electrodes Yi. This voltage is the same as the total write discharge voltage of the prior art of FIG. 7 in size and is opposite thereto in polarity. Namely, the prior art of FIG. 7 applies +300 V between the sustaining electrodes Xi and the scanning electrodes Yi. On the other hand, the present invention applies −300 V between the sustaining electrodes Xi and the scanning electrodes Yi. The prior art applies +100 V between the addressing electrodes Aj and the scanning electrodes Yi. On the other hand, the present invention applies −180 V between the addressing electrodes Aj and the scanning electrodes Yi. This voltage causes total write discharge on all of the electrodes, to accumulate excessive wall charges on the electrodes.

There are two reasons why the present invention does not apply a single voltage of −300 V to the sustaining electrodes Xi.

First, +180 V applied to the scanning electrodes Yi in the reset period is the same as the voltage of the sustain discharge pulse applied to the same electrodes in the sustain discharge period. Accordingly, a circuit for providing the scanning electrodes Yi with the sustain discharge pulses is usable for providing the same electrodes with +180 V in the reset period. If the sustaining electrodes Xi must receive −300 V, a separate circuit for providing the sustaining electrodes Xi with −300 V must be prepared. Instead, according to the present invention, the sustaining electrodes Xi need only a circuit for providing −120 V in the reset period.

Second, the present invention makes the polarity of a voltage between the sustaining electrodes Xi and the scanning electrodes Yi and the polarity of a voltage between the addressing electrodes Aj and the scanning electrodes Yi opposite to those corresponding voltages of the prior art. If −300 V must be supplied to the sustaining electrodes Xi, the polarity of the voltage between the sustaining electrodes Xi and the scanning electrodes Yi may be opposite to that of the prior art, but the voltage between the addressing electrodes Aj and the scanning electrodes Yi will the same as that of the prior art. Although inverting only the polarity of the voltage between the sustaining electrodes Xi and the scanning electrodes Yi or the polarity of the voltage between the addressing electrodes Aj and the scanning electrodes Yi will solve one of the problems of the prior art, it is preferable to solve both the problems. The structure of the present invention solves both the problems of the prior art without increasing the circuit scale.

When +180 V is applied to the scanning electrodes Yi, the addressing electrodes Aj are kept at the ground voltage (0 V). Usually, the potential difference between the addressing electrodes Aj and the scanning electrodes Yi is approximately in the middle of the potential difference between the sustaining electrodes Xi and the scanning electrodes Yi. If the potential difference between the electrodes Aj and Yi is too large or too small, a voltage margin to realize addressing discharge becomes smaller. Namely, a voltage range for enabling proper addressing discharge is narrowed. This is experimental data and the reason thereof is unclear. If the potential difference between the electrodes Aj and Xi is too large, the discharge cells will be destroyed. Accordingly, the embodiment applies +180 V to the scanning electrodes Yi. Only by keeping the addressing electrodes Aj at the ground voltage, the potential difference between the electrodes Aj and Yi is kept at about half the potential difference between the electrodes Xi and Yi.

It is preferable to make the width of each pulse applied to the sustaining electrodes Xi and scanning electrodes Yi to be in the range of 5 $\mu$m to 10 $\mu$m. If the pulse width exceeds this range, the discharge cells are hardly reset. This is also experimental data and the reason thereof is unclear. The reason is probably that if the pulse width is too narrow, the discharge cells insufficiently discharge, and if the pulse width is too wide, a large amount of wall charges, which are hardly neutralized, accumulate in a wide area.

After the application of the total write discharge pulses, the electrodes are equally set to the ground voltage (0 V). As a result, the potential difference among the wall charges excessively accumulated around the electrodes exceeds a discharge start voltage, to start discharge. This discharge substantially neutralizes the accumulated wall charges, to equalize the distribution of charges among the discharge cells. This is the self-erase discharge to reset the discharge cells.

In the following addressing period, display data are written into selected ones of the discharge cells. The sustaining electrodes Xi are kept at Vx (50 V), and a scan pulse of −Vy (−150 V) is applied successively to the scan electrodes Yi. When a given line is selected with the scan pulse of −Vy, an addressing pulse of Va (50 V) is selectively applied to the addressing electrodes Aj according to the display data. As a result, the discharge cells selected with the scanning electrodes Yi and addressing electrodes Aj carry out discharge to accumulate wall charges.

At this time, a voltage of +200 V acts between the sustaining electrodes Xi and the scanning electrodes Yi with the application of the scanning pulse. Also, a voltage of +200 V acts between the addressing electrodes Aj and the scanning electrodes Yi with the application of the scanning and addressing pulses. Namely, according to this embodiment, the polarity of the voltage applied between the scanning electrodes Yi and the sustaining electrodes Xi as well as the polarity of the voltage applied between the scanning electrodes Yi and the addressing electrodes Aj are reversed between the reset period and the addressing period. Also, the polarity of the voltage applied between the sustaining electrodes Xi and the addressing electrodes Aj is reversed between the reset period and the addressing period (when no addressing pulse is applied to the addressing electrodes Aj).

Although the embodiments relates to the "write addressing" technique of carrying out write discharge in selected discharge cells, the present invention is applicable to the "erase addressing" technique that carries out a total write operation on every discharge cell and then an erase discharge operation in unnecessary cells that do not display data.

In the sustain discharge period that follows the addressing period, a sustain discharge pulse of Vs (180 V) is alternatively applied to all of the sustaining electrodes Xi and scanning electrodes Yi. As a result, the discharge cells into which the display data have been written to accumulate wall charges in the addressing period exceed a discharge start voltage and repeatedly produce sustain discharge in response to the sustain discharge pulses.

The mode of operation of the embodiment will be explained with reference to models.

Figure 12A:
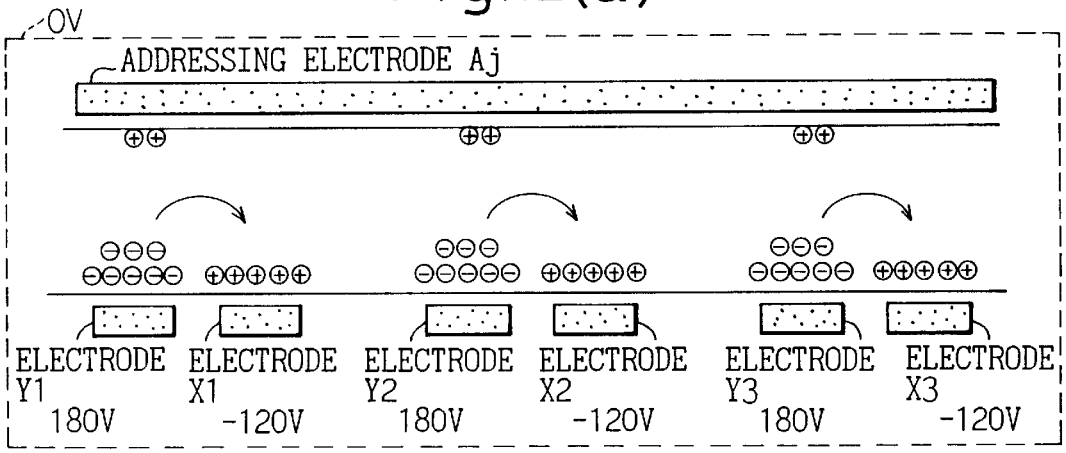
FIGS. 12(*a*) through 12(*c*) are models showing a total write discharge process, a total self-erase discharge process, and an addressing process, respectively, according to a first mode of operation of the first embodiment of the present invention.
Figure 12B:
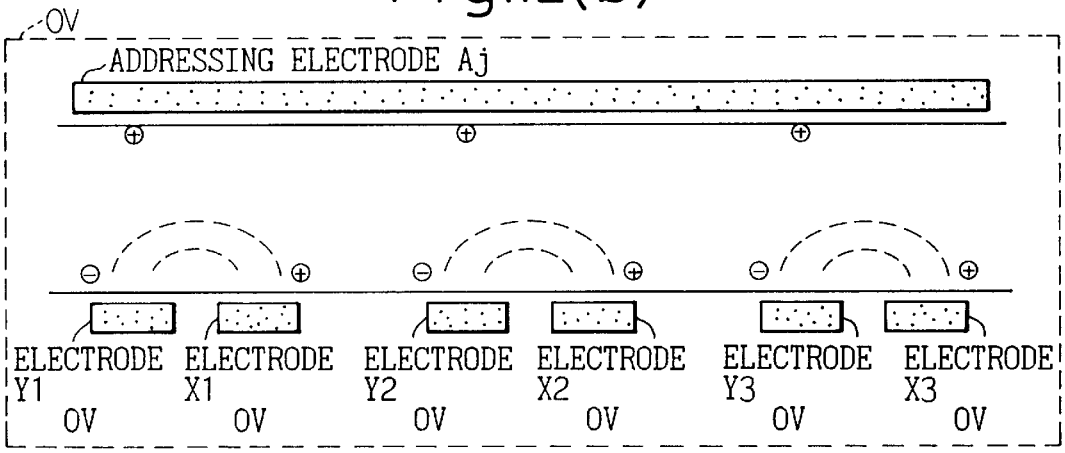
Figure 12C:
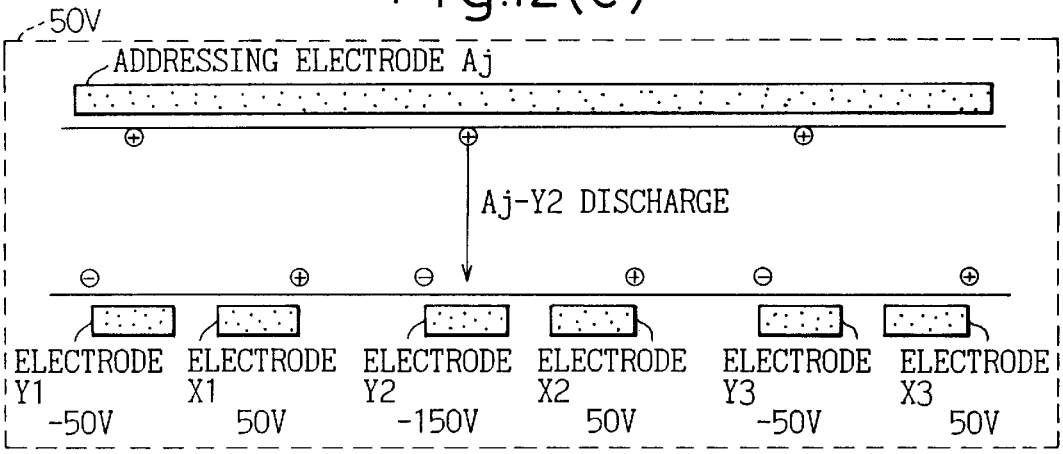
Figure 13A:
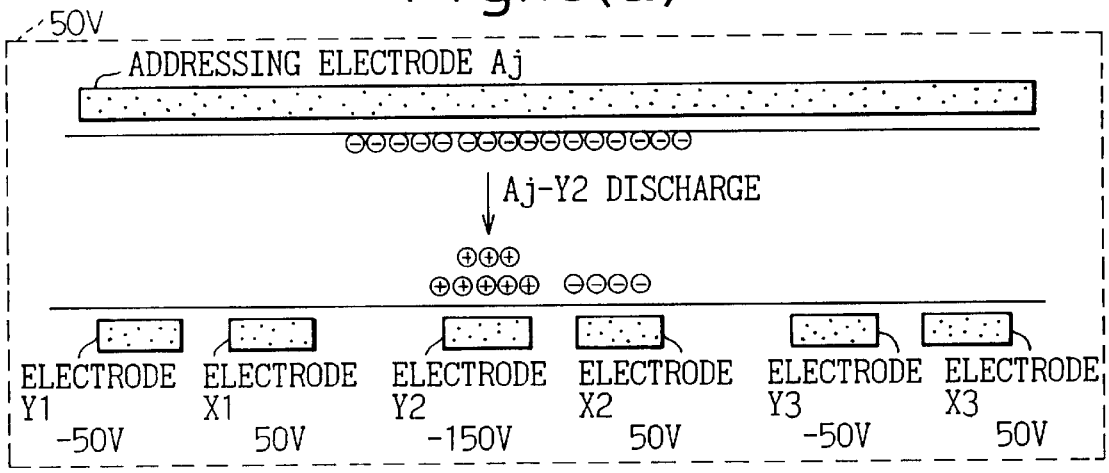
FIGS. 13(*a*) through 13(*e*) are models showing an addressing process, a sustain discharge process, a total write discharge process, a total self-erase discharge process, and the next addressing process, respectively, according to a second mode of operation of the first embodiment of the present invention.
Figure 13B:
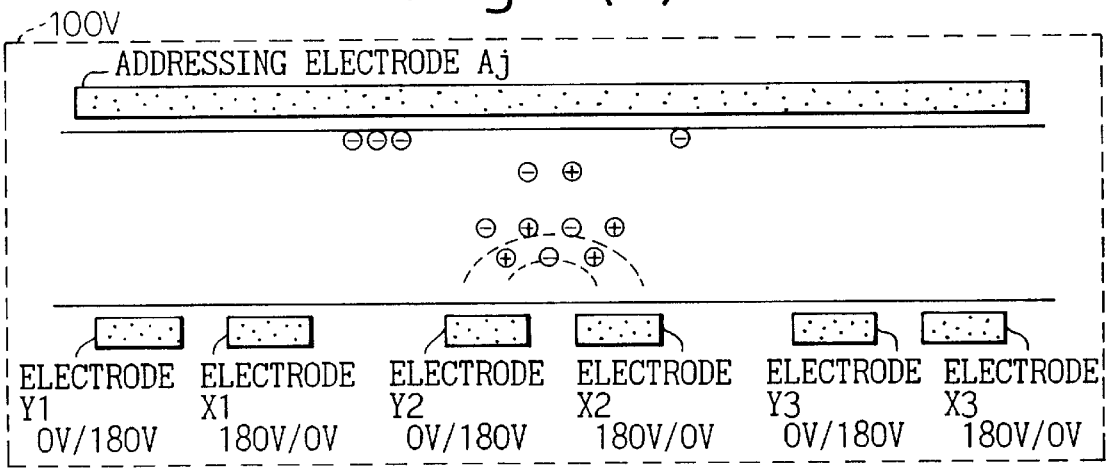
Figure 13C:
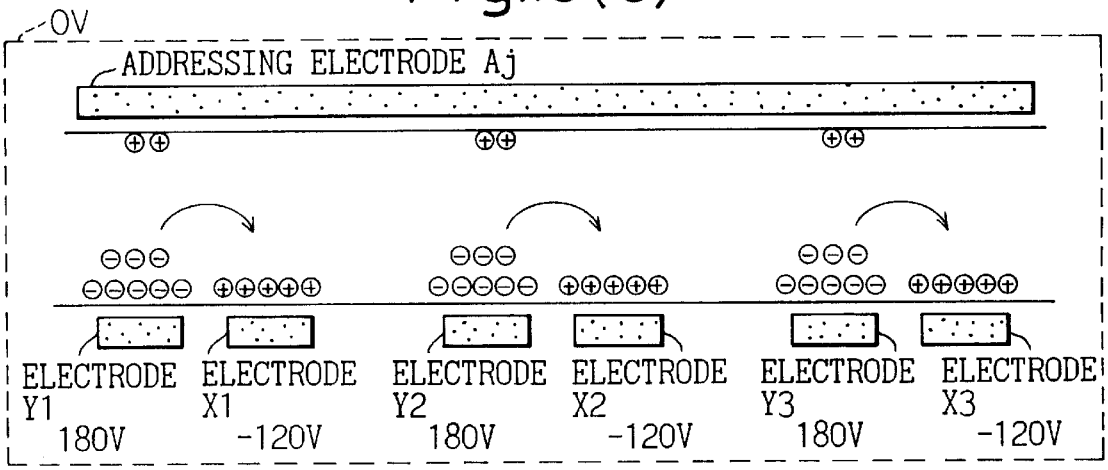
Figure 13D:
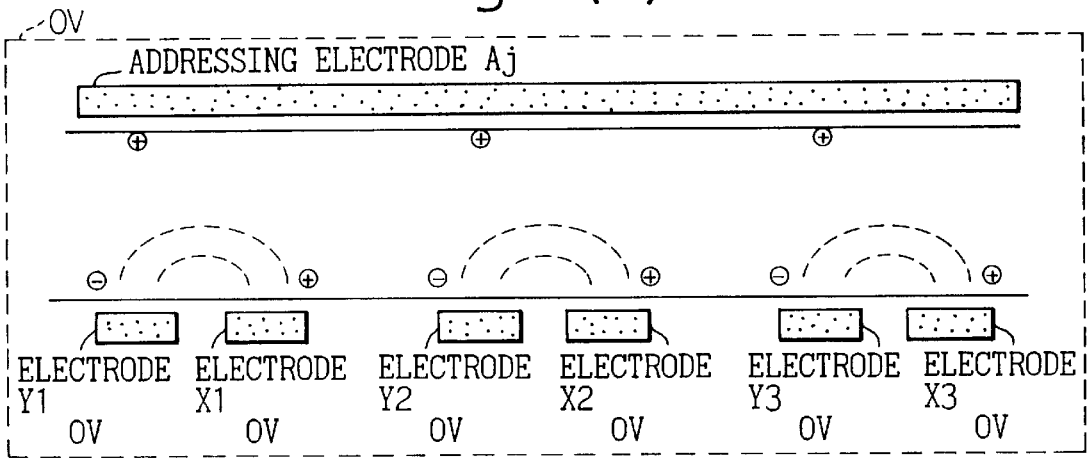
Figure 13E:
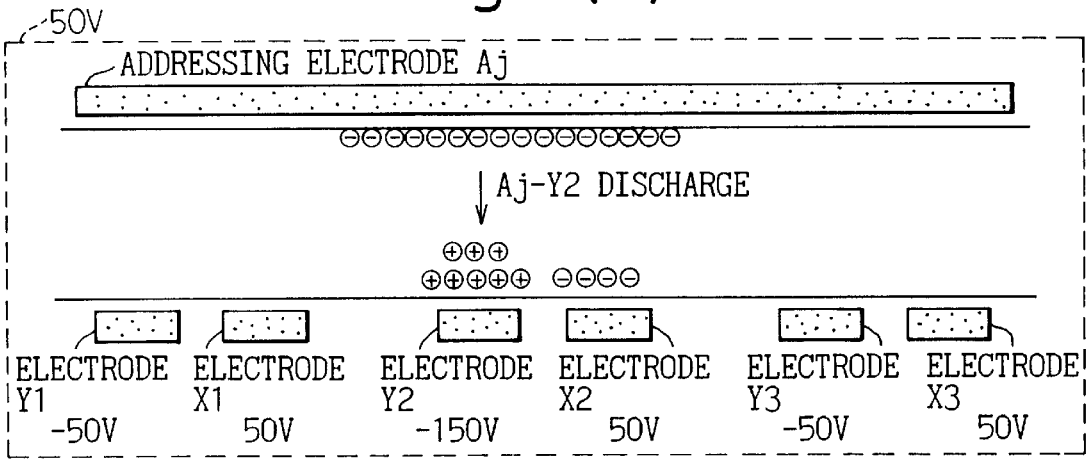

FIGS. 12(*a*) through 12(*c*) are models showing a total write discharge process, a total self-erase discharge process, and an addressing process, respectively, according to a first mode of operation of the first embodiment of the present invention. The total write discharge process of FIG. 12(*a*) applies, for example, −120 V to the sustaining electrodes Xi and 180 V to the scanning electrodes Yi, to form wall charges on the electrodes.

After the completion of the total self-erase discharge process of FIG. 12(*b*), the wall charges remain around, in particular, the counter slits of the sustaining electrodes Xi and scanning electrodes Yi. This phenomenon is the same as that of the prior art. An important thing here is the polarities of the remaining wall charges. Since the polarities of the voltages applied in the total write discharge process of FIG. 12(*a*) are opposite to those of the prior art, the polarities of the wall charges accumulated on the sustaining electrodes Xi and scanning electrodes Yi are opposite to those of the prior art.

The addressing process of FIG. 12(*c*) applies, similar to the prior art, 50 V to the sustaining electrodes Xi, −150 V successively to the scanning electrodes Yi, and 50 V to selected ones of the addressing electrodes Aj. According to the first embodiment of the present invention, the polarities of the remaining wall charges are additive to the addressing voltage acting between the electrodes Aj and Yi. Accordingly, the addressing voltage is not dropped by the remaining wall charges, and addressing discharge is stably carried out without employing a high addressing voltage.

FIGS. 13(*a*) to 13(*e*) are models showing an addressing process, a sustain discharge process, a total write discharge process, a total self-erase discharge process, and the next addressing process, respectively, according to a second mode of operation of the first embodiment of the present invention. The addressing process of FIG. 13(*a*) applies, similar to the prior art, 50 V to the sustaining electrodes Xi, −150 V successively to the scanning electrodes Yi, and 50 V to selected ones of the addressing electrodes Aj, thereby realizing addressing discharge to accumulate wall charges on the electrodes. In particular, the wall charges on the addressing electrodes Aj spread along the counter slits.

The sustain discharge process of FIG. 13(*b*) applies sustain pulses additively to the wall charges accumulated in the addressing process of FIG. 13(*a*), to produce sustain discharge. The wall charges around the counter slits in the vicinity of the addressing electrodes Aj partly remain even after the completion of the sustain discharge of FIG. 13(*b*). In the example, negative charges are left along the addressing electrodes Aj. The description to this point is the same as the prior art.

The total write discharge process of FIG. 13(*c*) applies −120 V to the sustaining electrodes Xi, 180 V to the scanning electrodes Yi, and 0 V to the addressing electrodes Aj. What is important in this process is that the polarity of the voltage acting between the addressing electrodes Aj and the scanning electrodes Yi is opposite to the polarity of the voltage acting between the same electrodes in the addressing process. Namely, the voltage of 0 V applied to the addressing electrodes Aj is negative with respect to the voltage of 180 V applied to the scanning electrodes Yi and is the same as the negative polarity of the remaining wall charges. Unlike the prior art, the remaining negative wall charges reinforce discharge in the total write discharge process. Consequently, the reinforced total write discharge completely neutralizes the remaining wall charges.

Thereafter, the total self-erase discharge process of FIG. 13(*d*) and the next addressing process of FIG. 13(*e*) are carried out. Since the wall charges left on the addressing electrodes Aj have completely been neutralized by the total write discharge process of FIG. 13(*c*), the processes of FIGS. 13(*d*) and 13(*e*) are carried out without problem.

In this way, the first embodiment of the present invention stably carries out addressing discharge without applying a high voltage.

Figure 14:
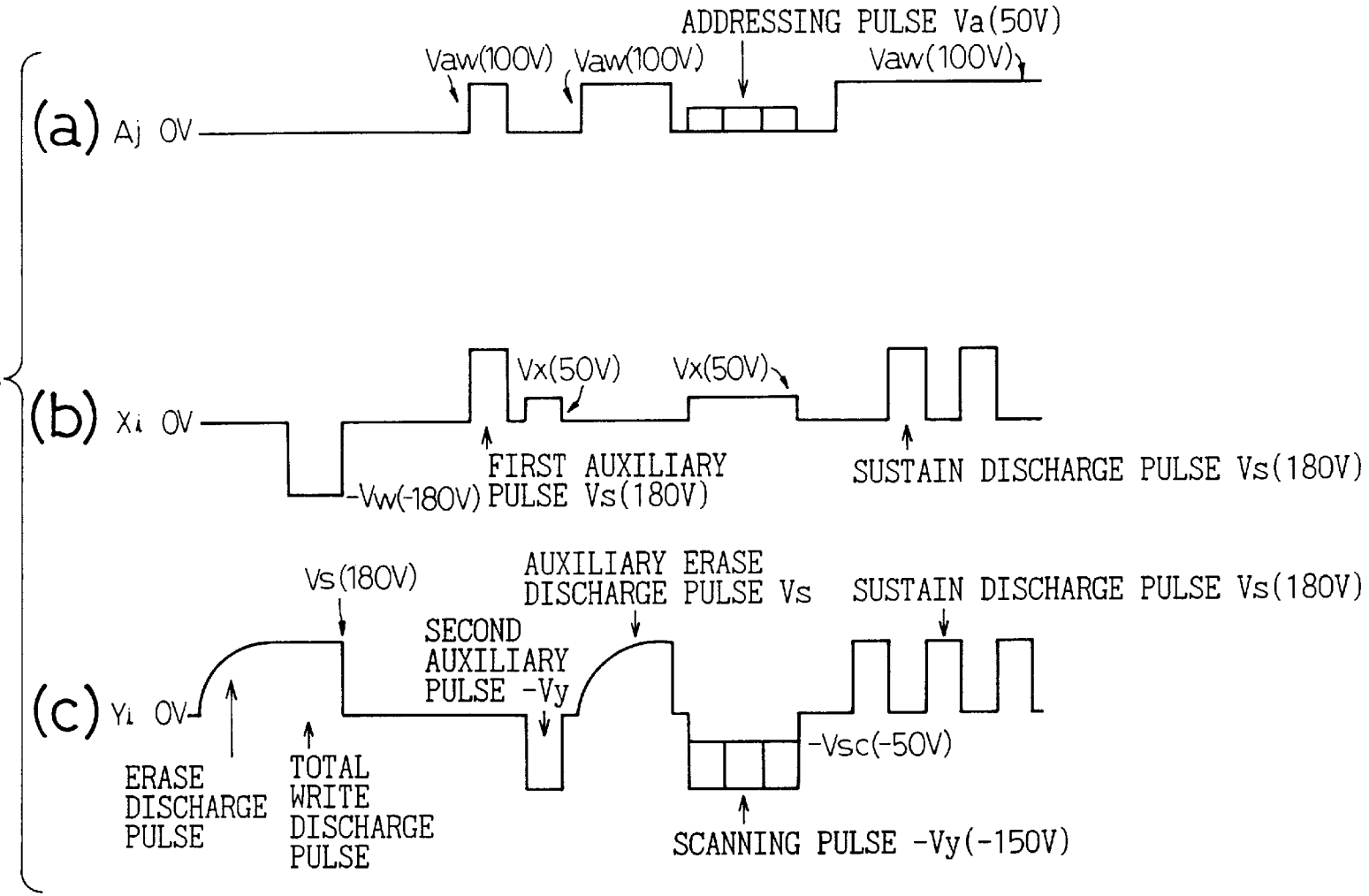
FIG. 14 shows waveforms for driving a plasma display panel according to a second embodiment of the present invention.

FIG. 14 shows waveforms for driving a plasma display panel according to the second embodiment of the present invention. In the figure, the (a) portion shows a voltage waveform applied to the addressing electrodes Aj, the (b)

portion shows a voltage waveform applied to the sustaining electrodes Xi, and the (c) portion shows a voltage waveform applied to the scanning electrodes Yi. The second embodiment adds several erase pulses to the first embodiment, to further stabilize the operation of the plasma display panel.

The second embodiment applies a gently rising erase discharge pulse to the scanning electrodes Yi in the reset period before the application of a total write discharge pulse. This erase discharge pulse increases to 180 V, that is equal to the level of the total write discharge pulse applied to the scanning electrodes Yi, and is integrated with the total write discharge pulse.

The erase discharge pulse erases wall charges remaining in discharge cells that have been turned on in the preceding subfield. The quantities of wall charges present in the discharge cells differ from cell to cell. Accordingly, the discharge cells have different discharge start voltages. A voltage actually applied to the discharge space of a given discharge cell is determined by voltages applied to the electrodes of the cell and the potential of wall charges accumulated in the cell. The gently rising erase discharge pulse lets the cells start discharging from one in which the sum of the potential of remaining wall charges and the applied voltages exceeds the discharge start voltage of the cell. Since each cell starts discharging at about its own discharge start voltage, no excessive wall charges remain therein after discharging. Consequently, the second embodiment is able to reset the cells without regard to the states of the cells.

The total write discharge process that follows the gently rising erase discharge pulse applies −180 V, instead of −120 V of the first embodiment, to the sustaining electrodes Xi. This is because it has been found through experiment that the voltage of −180 V leaves a smaller quantity of wall charges after the completion of the reset process. The first embodiment must substantially simultaneously apply the total write discharge pulses to the sustaining electrodes Xi and scanning electrodes Yi. This restriction is relieved in the second embodiment due to the erase discharge pulse. The total self-erase discharge that follows is the same as that of the first embodiment.

Discharge cells having structural defects or holding excessive wall charges after the total self-erase discharge may start addressing discharge or sustain discharge even if they are not selected. To prevent this, the present invention employs first and second auxiliary pulses and an auxiliary erase discharge pulse.

The first auxiliary pulse is identical to a sustain discharge pulse and is applied to the sustaining electrodes Xi, to neutralize wall charges remaining after the total write discharge. Similar to the sustain discharge process, 100 V is applied to the addressing electrodes Aj, and 180 V to the sustaining electrodes Xi. If wall charges remain in a given discharge cell after the reset period and if the quantity of the remaining wall charges is sufficient to achieve sustain discharge, the cell will discharge in the sustain discharge period even if the cell is not selected in the addressing period. Accordingly, such wall charges must be neutralized. The first auxiliary pulse detects any discharge cell holding such unwanted wall charges and amplifies them so that they are easily erased with the auxiliary erase discharge pulse that follows the first auxiliary pulse. The first auxiliary pulse and auxiliary erase discharge pulse prevent non-selected discharge cells from discharging in the sustain discharge process. The auxiliary erase discharge pulse has the same character as the gently rising erase discharge pulse applied in the reset period.

Some defective discharge cells have a very low discharge start voltage between the addressing electrode and the scanning electrode thereof. Such cells achieve addressing discharge only with a scanning pulse without an addressing pulse. In consideration of such cells, the present invention applies the second auxiliary pulse to the scanning electrodes Yi under the same conditions as the addressing discharge process. Similar to the addressing process, 50 V is applied to the sustaining electrodes Xi, and a pulse of −150 V, which is equal to the scanning pulse, to the scanning electrodes Yi. The second auxiliary pulse produces discharge in any discharge cell whose discharge start voltage is lower than a standard level and will probably cause addressing discharge without an addressing pulse. Thereafter, the auxiliary erase discharge pulse carries out erase discharge. At this time, the scanning electrode of the defective discharge cell holds a little positive wall charges whose polarity is opposite to that of wall charges to be accumulated by addressing discharge. Accordingly, these remaining wall charges act to drop a voltage applied to the cell in the following addressing period. Namely, the remaining wall charges serve to increase the discharge start voltage of the cell that defectively has the low discharge start voltage. As a result, the defective cell will never discharge if no addressing pulse is applied thereto. It has been confirmed through experiment that the voltage of 50 V applied to the sustaining electrodes Xi when the second auxiliary pulse is applied to the scanning electrodes Yi is not always necessary. Namely, the sustaining electrodes Xi may be set to the ground voltage.

The addressing period and sustain discharge period that follow the auxiliary erase discharge pulse are the same as those of the first embodiment.

FIG. 15 is a block diagram schematically showing a circuit for driving a plasma display panel according to the third embodiment of the present invention. The structure of FIG. 15 is mostly the same as that of the prior art of FIG. 1. The structure of FIG. 15 additionally has an X write circuit 21 connected to the X common driver 2 and X electrodes (sustaining electrodes). The same parts as those of FIG. 1 are represented with like reference marks.

Figure 16:
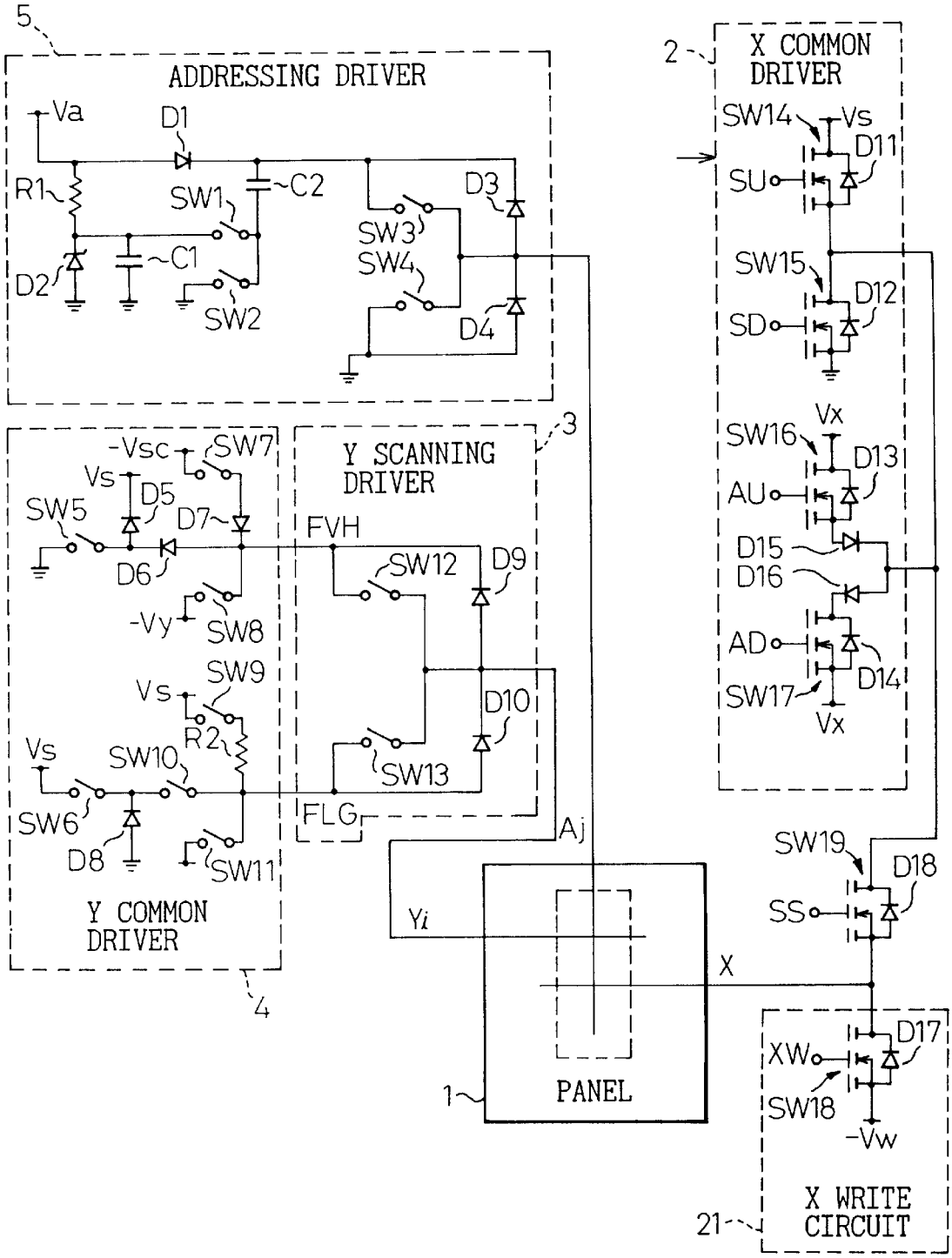
FIG. 16 is a circuit diagram showing a concrete example of the third embodiment of the present invention.

FIG. 16 is a circuit diagram showing a concrete example of the third embodiment of the present invention. It shows the details of the X common driver 2, X write circuit 21, Y scanning driver 3, Y common driver 4, and addressing driver 5.

First, the addressing driver 5 will be explained. A power source line for supplying a voltage of Va is connected to the anode of a diode D1 and to an end of a resistor R1. The other end of the resistor R1 is connected to the cathode of a zener diode D2, to an end of a capacitor C1, and to an end of a switching element SWI. The other end of the switching element SWI is connected to an end of a switching element SW2 and to an end of a capacitor C2. The other end of the capacitor C2 is connected to the cathode of the diode D1. The anode of the zener diode D2, the other end of the capacitor C1, and the other end of the switching element SW2 are connected to a ground line.

A terminal voltage of the capacitor C1 is equal to the breakdown voltage Vas of the zener diode D2. The potential of a node between the cathode of the diode D1 and the capacitor C2 is Va in the addressing period because the switching element SW1 is OFF and the switching element SW2 is ON in the addressing period. The potential of the same node in the sustain discharge period and when the first auxiliary pulse is applied is Vaw=Va+Vas because the switching element SW2 is OFF and the switching element SW1 is ON in the sustain discharge period, to add the voltage Va of the capacitor C2 to the voltage Vas of the capacitor C1.

The anode of a diode D3, the cathode of a diode D4, an end of a switching element SW3, and an end of a switching element SW4 are connected to a corresponding one of the addressing electrodes Aj. The cathode of the diode D3 and the other end of the switching element SW3 are connected to the node between the cathode of the diode D1 and the capacitor C2. The anode of the diode D4 and the other end of the switching element SW4 are connected to the ground line.

When the switching element SW3 is ON and the switching element SW4 OFF, the voltage Va or Vaw is applied to the addressing electrode. When the switching element SW3 is OFF and the switching element SW4 ON, 0 V is applied to the addressing electrode.

The Y common driver 4 commonly drives the scanning electrodes Yi, and the Y scanning driver 3 individually drives the scanning electrodes Yi. The output ends of the Y scanning driver 3 are connected to the scanning electrodes Yi, respectively. The output end of the Y common driver 4 is commonly connected to the input ends of the Y scanning driver 3.

The Y common driver 4 will be explained. An end of a switching element SW5 is connected to the ground line, and an end of a switching element SW6 is connected to a power source line for providing a voltage of Vs. The other end of the switching element SW5 is connected to the power source line of Vs through the anode and cathode of a diode D5 and to a line FVH through the cathode and anode of a diode D6. The line FVH is connected to a power source line for providing a voltage of −Vsc through the cathode and anode of a diode D7 and a switching element SW7. The line FVH is also connected to a power source line for providing a voltage of −Vy through a switching element SW8. The other end of the switching element SW6 is connected to the ground line through the cathode and anode of a diode D8 and to a line FLG through a switching element SW10. The line FLG is connected to the power source line of Vs through a resistor R2 and a switching element SW9 and to the power source line of −Vy through a switching element SW1.

In the Y scanning driver 3, the anode of a diode D9, the cathode of a diode D10, an end of a switching element SW12, and an end of a switching element SW13 are connected to a corresponding one of the scanning electrodes Yi. The cathode of the diode D9 and the other end of the switching element SW12 are connected to the line FVH. The anode of the diode D10 and the other end of the switching element SW13 are connected to the line FLG.

In the reset period, the switching element SW8 is ON, and the other switching elements are OFF. As a result, a current from the scanning electrode passes through the diode D9, line FVH, and switching element SW8, thereby applying the second auxiliary pulse of −Vy to the scanning electrode. When the switching element SW9 is ON and the other switching elements OFF, the gently rising auxiliary erase discharge pulse of Vs is applied to the scanning electrode through the resistor R2 and diode D10. The slope of the rise of the auxiliary erase discharge pulse is determined by the resistor R2 and static capacitance between the electrodes concerned.

In the sustain discharge period and in the reset period without the erase discharge pulse, the sustain pulse of Vs is applied to the scanning electrode by turning on the switching elements SW6 and SW10 and off the other switching elements. Namely, the voltage of Vs passes through the switching elements SW6 and SW10 and diode D10. If the erase pulse is employed, the switching element SW9 is turned on and the other switching elements off, similar to providing the auxiliary erase discharge pulse, thereby providing the gently rising pulse with the use of the resistor R2 and static capacitance between the electrodes concerned.

In the addressing period, the switching elements SW7 and SW11 are turned on, and the other switching elements off, to apply a non-selecting voltage of −Vsc and a selecting voltage of −Vy to the scanning electrode. At this time, the switching element SW10 is OFF, to prevent a current from flowing to the power source line of −Vy through the diode D8. Under this state, the switching element SW13 is turned on to apply the scanning pulse of −Vy to the scanning electrode, and the switching element SW12 is turned on to apply the non-selecting voltage of −Vsc to the scanning electrode. This operation is carried out successively on the scanning electrodes Yi (i=1 to N).

To drop the positive potential of the scanning electrode to 0 V, the switching element SW5 is turned on, and the other switching elements off. Then, a current from the scanning electrode flows through the diodes D9 and D6 and switching element SW5, to set the scanning electrode to 0 V. To increase the negative potential of the scanning electrode to 0 V, the switching element SW10 is turned on, and the other switching elements off. As a result, a current passes through the diode D8, switching element SW10, and diode D10, to set the scanning electrode to 0 V.

The X common driver 2 will be explained. Switching elements SW14 and SW15 are connected in series between the power source line of Vs and the ground line. The switching element SW14 is connected in parallel with a diode D11. The switching element SW15 is connected in parallel with a diode D12. An end of a switching element SW16 is connected to a power source line for supplying a voltage of Vx, and the other end thereof is connected to the anode of a diode D15. An end of a switching element SW17 is connected to the power source line of Vx, and the other end thereof is connected to the cathode of a diode D16. The switching element SW16 is connected in parallel with a diode D13. The switching element SW17 is connected in parallel with a diode D14. The cathode of the diode D15 is connected to the anode of the diode D16, and a node between them is connected to a node between the switching elements SW14 and SW15.

The X write circuit 21 consists of a switching element SW18 and a diode D17. An end of the switching element 18 is connected to a power source line for supplying a voltage of −Vw. The diode D17 and switching element SW18 are connected in parallel with each other.

The output of the X common driver 2 is connected to an end of a switching element SW19. The other end of the switching element SW19 is connected to the other end of the switching element SW18 of the X write circuit 21 and to all of the sustaining electrodes Xi. The switching element SW19 is connected in parallel with a diode D18.

In this embodiment, each of the switching elements is a D-FET that is a power FET capable of receiving large power. The D-FET (shown in the models of the X common driver 2 and X write circuit 21) has fixed source and drain, and therefore, passes a current only in one direction. At the same time, the D-FET has a parasitic diode of the opposite direction. Accordingly, using the D-FET may eliminate a diode to be connected in parallel with each element.

Figure 17:
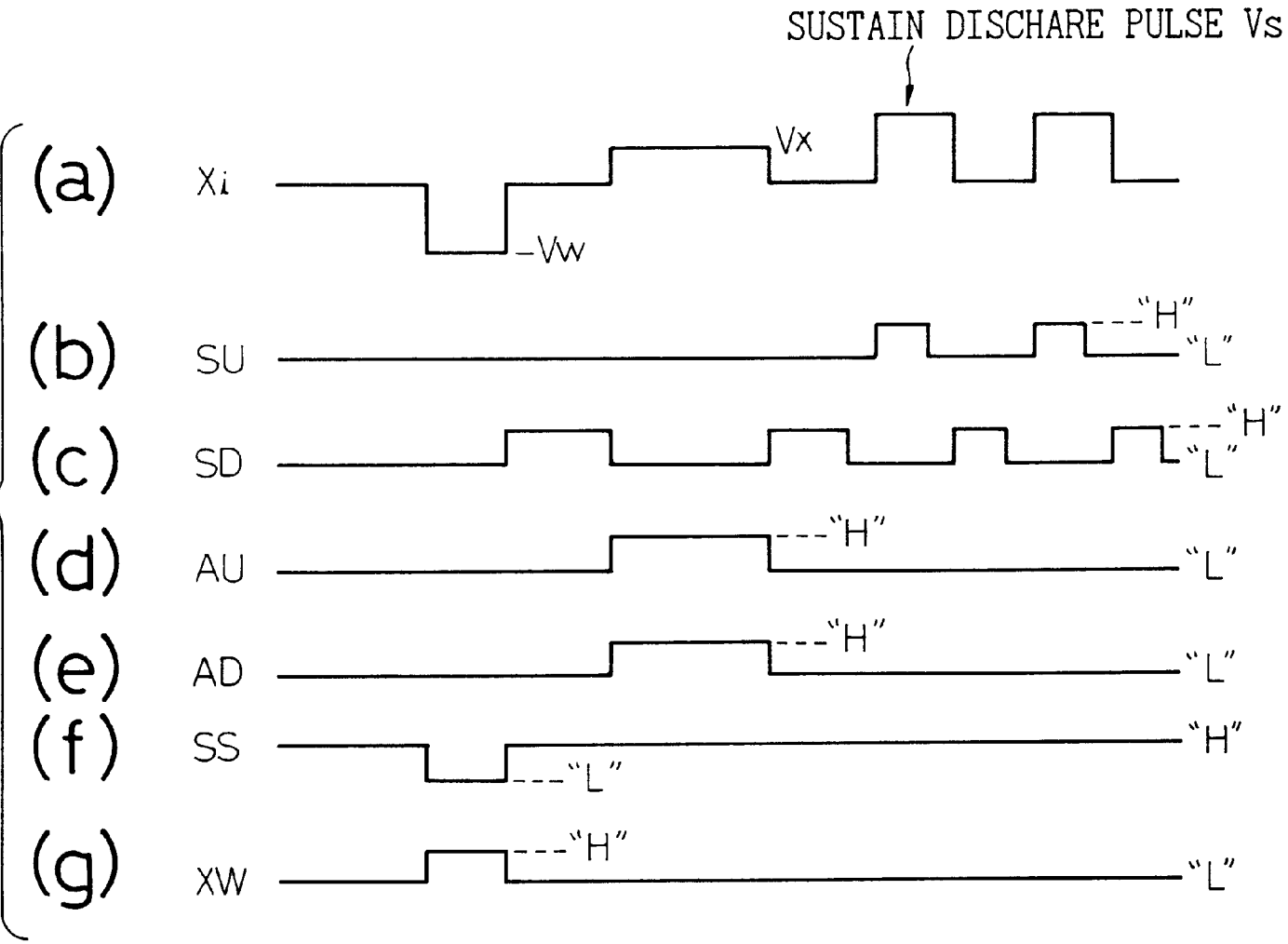
FIG. 17 is a timing chart explaining the operation of the circuit according to the third embodiment of the present invention.

FIG. 17 is a timing chart showing the operation of the circuit of the third embodiment of the present invention. In particular, it shows the operation timing of the X common driver 2 and X write circuit 21. In FIG. 17, the (a) portion shows a voltage waveform applied to the sustaining electrodes Xi, the (b) portion shows a control signal SU for the switching element SW14, the (c) portion shows a control signal SD for the switching element SW15, the (d) portion shows a control signal AU for the switching element SW16, the (e) portion shows a control signal AD for the switching element SW17, the (f) portion shows a control signal SS for the switching element SW19, and the (g) portion shows a control signal XW for the switching element SW18.

In the reset period, only the control signal XW is "H (High)" and the other control signals are each "L (Low)." Accordingly, only the switching element SW18 is ON to drop the potential of the sustaining electrodes Xi to the write voltage of −Vw through the switching element SW18. At this time, there is a risk that the potential of the sustaining electrodes Xi becomes lower than the write voltage of −Vw, to cause undershooting. If this happens, the present invention returns an excessive voltage to the sustaining electrodes Xi through the diode D17, to settle (or stop) the undershooting.

When supplying the voltage of Vx for the second auxiliary pulse and for the addressing period, the control signals AU, AD, and SS are "H" and the other signals "L." Accordingly, the switching elements SW16 and SW17 are ON, to supply the voltage of Vx to the sustaining electrodes Xi through the switching element SW19 that is also ON. The present invention employs the two switching elements SW16 and SW17 for supplying the voltage Vx. It has been found that, if there is only one switch, the potential of the sustaining electrodes Xi fluctuates due to static capacitance between the electrodes concerned when the addressing pulse of Va is applied to the addressing electrodes Aj. To prevent such fluctuation, the present invention provides the voltage of Vx from a node between the switching elements SW16 and SW17 connected to the power source line of Vx.

To supply the voltage Vs for the first auxiliary pulse and for the sustain discharge period, the control signals SU and SS are "H" and the other signals are "L." This turns on the switching element SW14 and supplies the voltage Vs to the sustaining electrodes Xi through the switching element SW19. At this time, there is a risk of increasing the potential of the sustaining electrodes Xi over the voltage of Vs, to cause overshooting. In this case, the present invention draws an excessive voltage from the sustaining electrodes Xi through the diode D11, to settle the overshooting.

The operation of setting the sustaining electrodes Xi to the ground voltage differs depending on whether the potential of the sustaining electrodes Xi is increased or decreased to the ground voltage. To increase the potential of the sustaining electrodes Xi that are receiving the write voltage of −Vw to the ground voltage, only the control signal SS becomes "H" and the other signals "L." As a result, the ground voltage is supplied to the sustaining electrodes Xi through the diode D12 and switching element SW19. On the other hand, to drop the potential of the sustaining electrodes Xi that are receiving the voltage of Vs to the ground voltage, only the control signal SD becomes "H" and the other signals "L." This turns on the switching element SW15, and the potential of the sustaining electrodes Xi is dropped to the ground voltage through the diode D18 and switching element SW15.

When supplying the ground voltage to the sustaining electrodes Xi, there is a risk of increasing the potential of the sustaining electrodes above the ground voltage, to cause overshooting. Accordingly, the embodiment turns on the switching element SW15, to draw an excessive voltage from the sustaining electrodes Xi. When dropping the sustaining electrodes Xi to the ground voltage, the switching element SW19 is turned on and off whenever the sustain discharge pulse of Vs is applied to the sustaining electrodes Xi, to increase power consumption. To solve this problem, the embodiment keeps the switching element SW19 ON.

To prevent a fluctuation in the potential of the sustaining electrodes Xi when dropping the potential of the scanning electrodes Yi, the diode D12 has a function of supplying the ground voltage to the sustaining electrodes Xi.

The X write circuit 21 is separated from the X common driver 2 by the switching element SW19. This prevents, when the switching element SW18 is ON, a through current from flowing from the ground to the power source line of −Vw through the diode D12 and switching element SW18. When operating the X write circuit 21, the embodiment turns off the switching element SW19 between the X common driver 2 and the X write circuit 21.

We claim:

1. A method of driving a plasma display panel having a first substrate, first and second electrodes formed on the first substrate, each pair of the first and second electrodes extending in parallel with each other and corresponding to a display line, a second substrate facing the first substrate, third electrodes formed on one of the first and second substrates orthogonal to and electrically separated from the first and second electrodes, and discharge cells formed at intersections of the first and second electrodes and the third electrodes, said method comprising:

in a reset period, producing a potential difference between the first and second electrodes and resulting reset discharges in the discharge cells to accumulate wall charges therein so that a potential difference among the wall charges achieves self-erase discharges and equalizes the distribution of charges among the discharge cells;

in an addressing period, producing selective discharges with the second and third electrodes in selected ones of the discharge cells, in accordance with writing display data into the selected discharge cells;

in a sustain discharge period, applying sustain discharge pulses to the first and second electrodes, enabling the selected discharge cells to discharge and emit light; and setting the polarity of the potential difference between the first and second electrodes in the reset period to be opposite to the polarity of the potential difference between the first and second electrodes in the addressing period.

2. The method of claim 1, further comprising producing the reset discharges by applying a first pulse having a first polarity to the first electrodes and a second pulse having a second polarity to the second electrodes.

3. The method of claim 1 further comprising, in the reset period, setting the polarity of the potential difference between the first and third electrodes to be opposite to the polarity of the potential difference between the first and third electrodes in the addressing period.

4. The method of claim 1, further comprising applying a first auxiliary pulse, having the same magnitude as the sustain discharge pulse, to the first or second electrodes after the completion of the self-erase discharge and before the selective discharge carried out in the addressing period.

5. The method of claim 4, further comprising applying a second auxiliary pulse, having the same magnitude as a pulse applied to the second electrodes in the addressing period to achieve the selective discharge, to the second or first electrodes after the completion of the self-erase discharge and before the selective discharge to be carried out in the addressing period.

6. The method of claim 2, wherein one of the first and second pulses has the same magnitude as the sustain discharge pulse.

7. The method of claim 2, wherein the width of each of the first and second pulses is in the range of 5 $\mu$s to 10 $\mu$s.

8. The method of claim 2, further comprising applying a gently rising erase discharge pulse to one of the first and second electrodes just before the reset discharge takes place.

9. The method of claim 8, further comprising forming the gently rising erase discharge pulse so as to gently rise up to the level of one of the first and second pulses and to be integrated therewith.

10. The method of claim 2, further comprising applying a ground voltage to the third electrode during the reset period.

11. The method of claim 4, further comprising applying the first auxiliary pulse, as a positive pulse, to the first electrodes while the second electrodes are receiving a ground voltage and the third electrodes are receiving a positive pulse that is lower than the sustain discharge pulse.

12. The method of claim 4, further comprising applying a gently rising auxiliary erase discharge pulse to one of the second and first electrodes after the application of the first auxiliary pulse and before the selective discharge carried out in the addressing period.

13. The method of claim 5, further comprising applying the second auxiliary pulse, as a negative pulse, to the second electrodes while the third electrodes are receiving a ground voltage and the first electrodes are receiving the ground voltage or the voltage applied to the first electrodes during the selective discharge in the addressing period.

14. The method of claim 5, further comprising applying a gently rising auxiliary erase discharge pulse to one of the second and first electrodes after the application of the second auxiliary pulse and before the selective discharge to be carried out in the addressing period.

15. A method of driving a plasma display panel having a first substrate, first and second electrodes formed on the first substrate, each pair of the first and second electrodes extending in parallel with each other and corresponding to a display line, a second substrate facing the first substrate, third electrodes formed on one of the, first and second substrates orthogonal to and electrically separated from the first and second electrodes, and discharge cells formed at intersections of the first and second electrodes and the third electrodes, said method comprising:

in a reset period, producing a potential difference between the first and second electrodes and resulting reset discharges in the discharge cells to accumulate wall charges therein so that a potential difference among the wall charges achieves self-erase discharges and equalizes the distribution of charges among the discharge cells;

in an addressing period, carrying out selective discharges with the second and third electrodes in selected ones of the discharge cells, and writing display data into the selected discharge cells;

in a sustain discharge period, applying sustain discharge pulses to the first and second electrodes, enabling the selected discharge cells to discharge and emit light; and setting the polarity of the potential difference between the second and third electrodes in the reset period to be opposite to the polarity of the potential difference between the second and third electrodes in the addressing period.

16. The method of claim 15, further comprising producing the reset discharges by, further, applying a first pulse having a first polarity to the first electrodes and a second pulse having a second polarity to the second electrodes.

17. The method of claim 15, further comprising, in the resent period, setting the polarity of the potential difference between the first and third electrodes to be opposite to the polarity of the potential difference between the first and third electrodes in the addressing period.

18. The method of claim 15, further comprising applying a first auxiliary pulse, having the same magnitude as the sustain discharge pulse, to the first or second electrodes after the completion of the self-erase discharge and before the selective discharge carried out in the addressing period.

19. The method of claim 15, further comprising applying a second auxiliary pulse, having the same magnitude as a pulse applied to the second electrodes in the addressing period to achieve the selective discharge, to the second or first electrodes after the completion of the self-erase discharge and before the selective discharge carried out in the addressing period.

20. The method of claim 16, wherein one of the first and second pulses has the same magnitude as the sustain discharge pulse.

21. The method of claim 16, wherein the width of each of the first and second pulses is in the range of 5 $\mu$s to 10 $\mu$s.

22. The method of claim 16, further comprising applying a gently rising erase discharge pulse to one of the first and second electrodes just before the reset discharge takes place.

23. The method of claim 22, further comprising forming the gently rising erase discharge pulse so as to gently rise up to the level of one of the first and second pulses and to be integrated therewith.

24. The method of claim 16, further comprising applying a ground voltage to the third electrodes during the reset period.

25. The method of claim 18, further comprising applying the first auxiliary pulse, a positive pulse, to the first electrodes while the second electrodes are receiving a ground voltage and the third electrodes are receiving a positive pulse that is lower than the sustain discharge pulse.

26. The method of claim 18, further comprising applying a gently rising auxiliary erase discharge pulse to one of the second and first electrodes after the application of the first auxiliary pulse and before the selective discharge carried out in the addressing period.

27. The method of claim 19, further comprising applying the second auxiliary pulse, as a negative pulse, to the second electrodes while the third electrodes are receiving a ground voltage and the first electrodes are receiving the ground voltage or the voltage applied to the first electrodes during the selective discharge in the addressing period.

28. The method of claim 19, further comprising applying a gently rising auxiliary erase discharge pulse to one of the second and first electrodes after the application of the second auxiliary pulse and before the selective discharge to be carried out in the addressing period.

29. An apparatus for driving a plasma display panel having a first substrate, first and second electrodes formed on the first substrate, each pair of the first and second electrodes extending in parallel with each other and corresponding to a display line, a second substrate facing the first substrate, third electrodes formed on one of the first and second substrates orthogonal to and electrically separated from the first and second electrodes, and discharge cells formed at intersections of the first and second electrodes and the third electrodes, said apparatus comprising:

a controller repeating a reset period producing a potential difference between the first and second electrodes and resulting reset discharge in the discharge cells to accumulate wall charges therein so that a potential difference among the wall charges achieves self-erase discharges and equalizes the distribution of charges among the discharge cells, an addressing period for carrying out selective discharge with the second and third electrodes in selected ones of the discharge cells, to write display data into the selected discharge cells, and a sustain discharge period for applying sustain discharge pulses to the first and second electrodes, to let the selected discharge cell, discharge and emit light; and respective circuits driving the first, second, and third electrodes so that the polarity of the potential difference between the first and second electrodes in the reset period is opposite to the polarity of the potential difference between the first and second electrodes in the addressing period.

30. The apparatus of claim 29, wherein the first electrodes driving circuit comprises a first push-pull-type switching element pair providing the first electrodes with the sustain discharge pulses, a second push-pull-type switching element pair providing the first electrodes with a voltage in the addressing period, and a third switching element providing the first electrodes with the predetermined voltage to achieve the reset discharge.

31. An apparatus for driving a plasma display panel having a first substrate, first and second electrodes formed on the first substrate, each pair of the first and second electrodes extending in parallel with each other and corresponding to a display line, a second substrate facing the first substrate, third electrodes formed on one of the first and second substrates orthogonal to and electrically separate from the first and second electrodes, and discharge cells formed at intersections of the first and second electrodes and the third electrodes, said apparatus comprising:

a controller repeating a reset period producing a potential difference between the first and second electrodes and resulting reset discharges in the discharge cells to accumulate wall charges therein so that the potential difference among the wall charges achieves self-erase discharge equalizing the distribution of charges among the discharge cells, an addressing period for carrying out selective discharge with the second and third electrodes in selected ones of the discharge cells, to write display data into the selected discharge cells, and a sustain discharge period for applying sustain discharge pulses to the first and second electrodes, to let the selected discharge cells discharge and emit light; and respective circuits driving the first, second, and third electrodes so that the polarity of the potential difference between the second and third electrodes in the reset period is opposite to the polarity of the potential difference between the second and third electrodes in the addressing period.

32. The apparatus of claim 31, wherein the first electrodes driving circuit comprises a first push-pull-type switching element pair providing the first electrodes with the sustain discharge pulses, a second push-pull-type switching element pair providing the first electrodes with a voltage in the addressing period, and a third switching element providing the first electrodes with the predetermined voltage to achieve the reset discharge.

33. The apparatus of claim 32, further comprising a fourth switching element connecting the first and second switching element pairs to the first electrodes and the third switching element.

34. An apparatus for driving a plasma display panel having pairs of first and second electrodes extending in parallel on a first substrate, each pair corresponding to a display line, and a second substrate, facing the first substrate, having third electrodes formed thereon disposed orthogonally to and electrically separated from the first and second electrodes and defining discharge cells at intersections of the third electrodes with the first and second electrodes, comprising:

a controller defining reset, addressing and sustain discharge periods in a continuing succession;

drive circuits producing, in each reset period, a potential difference between the first and second electrodes and resulting in reset discharges in the discharge cells to accumulate wall charges therein having a potential difference achieving self-erase discharge and equalizing the distribution of charges among the discharge cells, in each addressing period, discharges with the second and third electrodes in selected ones of the discharge cells in accordance with writing display data into the selected discharge cells, and, in each sustain discharge period, sustain discharge pulses applied to the first and second electrodes enabling the selected discharge cells to discharge and emit light; and the controller controlling the polarity of the potential difference between the first and second electrodes in each reset period to be opposite the polarity of the potential difference between the first and second electrodes in each addressing period.

35. The drive circuit apparatus recited in claim 34, wherein the drive circuit which produces reset discharges applies a first pulse having a first polarity to the first electrodes and a second pulse having a second polarity to the second electrodes to produce a reset discharge.

36. The drive circuit apparatus recited in claim 35, wherein the drive circuit which produces reset discharges, further, sets the polarity of the potential difference between the first and third electrodes in the reset period to be opposite to the polarity of the potential difference between the first and third electrodes in the addressing period.

37. The drive circuit apparatus recited in claim 34, wherein the drive circuits further comprise an auxiliary pulse drive circuit applying a first auxiliary pulse, having the same magnitude as the sustain discharge pulse, to the first or second electrodes after the completion of the self-erase discharge and before the selective discharge carried out in the addressing period.

38. The drive circuit apparatus recited in claim 37, wherein the auxiliary pulse drive circuit, further, applies a second auxiliary pulse, having the same magnitude as a pulse applied to the second electrodes in the address period to achieve the selective discharge, to the second or first electrodes after the completion of the self-erase discharge and before carrying out the selective discharge in the addressing period.

39. The drive circuit apparatus recited in claim 35, wherein the reset discharge drive circuit which produces reset discharges applies first and second pulses, each of the same magnitude as the sustain discharge pulse, to produce a reset discharge.

40. The drive circuit apparatus recited in claim 35, wherein the drive circuit which produces reset discharges applies the first and second pulses having a common width in the range of 5 $\mu$s to 10 $\mu$s.

41. The drive circuit apparatus recited in claim 35, wherein the reset drive circuit which produces reset discharges applies a gently rising erase discharge pulse to one of the first and second electrodes just before the reset discharge takes place.

42. The drive circuit apparatus recited in claim 41, wherein the drive circuit which produces reset discharges produces the gently rising erase discharge pulse so as to gently rise up to the level of one of the first and second pulses and be integrated therewith.

43. An apparatus driving a plasma display panel in which each of plural display lines is defined by a corresponding pair of first and second parallel electrodew on a first substrate and each of plural discharge cells along each display line is defined by an intersection therewith of a corresponding third electrode on a second substrate, spaced from the first substrate and with the discharge cell therebetween, reset, addressing and sustain periods so as to produce, in each reset period, a reset discharge in each of the plural discharge cells achieving self-erase discharge and equalizing the distribution of charges among the plural discharge cells, in each addressign period, addressing discharges between the second and third electrodes in selected ones of the discharge cells in accordance with writing display data therein and, in each sustain period, sustain discharges between the second and third electrodes in correspondence to the written discharge cells, to emit light and produce a display of the display data, the apparatus comprising:

a controller controlling the polarity of the potential difference between the first and second electrodes in each reset period to be opposite the polarity of the potential difference between the first and second electrodes in each addressing period.

44. A method of driving a plasma display panel in which each of plural display lines is defined by a corresponding pair of first and second parallel electrodes on a first substrate and each of plural discharge cells along each display line is defined by an intersection therewith of a corresponding third electrode on a second substrate, spaced from the first substrate and with the discharge cell therebetween, reset, addressing and sustain voltages being applied to the electrodes in corresponding reset, addressing, and sustain periods so as to produce, in each reset period, a reset discharge in each of the plural discharge cells achieving self-erase discharge and equalizing the distribution of charges among the plural discharge cells, in each addressing period, addressing discharges between the second and third electrodes, in selected ones of the discharge cells in accordance with writing display data therein and, in each sustain period, sustain discharges between the second and third electrodes in correspondence to the written discharge cells, to emit light and produce a display of the display data, the method comprising:

controlling the polarity of the potential difference between the first and second electrodes in each reset period to be opposite the polarity of the potential difference between the first and second electrodes in each addressing period.

* * * * *

UNITED STATES PATENT AND TRADEMARK OFFICE

CERTIFICATE OF CORRECTION

PATENT NO.: 6,034,482
DATED : March 7, 2000
INVENTOR(S): Yoshikazu KANAZAWA et al.

It is certified that error appears in the above-identified patent and that said Letters Patent is hereby corrected as shown below:

Col. 24, line 38, after "pulse," insert --as--.

Col. 25, line 3, change "discharge" (1st occurrence) to --discharges--;
line 13, change "cell," to --cells--;
line 42, change "discharON" to --discharges--.

Col. 27, line 10, change "electrodew" to --electrodes--;
line 15, after "sustain" add --voltages being applied to the electrodes in corresponding reset, addressing second sustain--;
line 19, change "addresign" ON --addressing--.

Col. 28, line 27, before "* * * * *" insert the following claims 45-49 which were omitted in the patent:

--45. The method of claim 1, wherein the reset discharges are produced in the discharge cells in each reset period by applying predetermined voltages to the selected ones of the first, second and third electrodes.

UNITED STATES PATENT AND TRADEMARK OFFICE

CERTIFICATE OF CORRECTION

PATENT NO.: 6,034,482
DATED : March 7, 2000
INVENTOR(S): Yoshikazu KANAZAWA et al.

It is certified that error appears in the above-identified patent and that said Letters Patent is hereby corrected as shown below:

46. The method of claim 15, wherein the reset discharges are produced in the discharge cells in each reset period by applying predetermined voltages to selected ones of the first, second and third electrodes.

47. The apparatus of claim 29, wherein the controller carries out the reset discharges in each reset period by applying predetermined, respective voltages to selected ones of the first, second and third electrodes.

48. The apparatus of claim 31, wherein the controller carries out the reset discharges in each reset period by applying predetermined, respective voltages to selected ones of the first, second and third electrodes.

49. The apparatus of claim 34, wherein the drive circuits produce reset charges in each reset period by applying respective, predetermined voltages respectively to selected ones of the first, second and third electrodes.--

Signed and Sealed this

Second Day of January, 2001

*Attest:*

Q. TODD DICKINSON

*Attesting Officer*

*Commissioner of Patents and Trademarks*